US008041267B2

(12) United States Patent
Nakagawa et al.

(10) Patent No.: US 8,041,267 B2
(45) Date of Patent: Oct. 18, 2011

(54) DEVELOPING DEVICE, PROCESS CARTRIDGE, AND IMAGE FORMING APPARATUS

(75) Inventors: Yoshinori Nakagawa, Kanagawa (JP); Yasuyuki Ishii, Tokyo (JP); Masaaki Yamada, Tokyo (JP); Hideki Kosugi, Kanagawa (JP); Tomoko Takahashi, Kanagawa (JP); Ichiro Kadota, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 378 days.

(21) Appl. No.: 12/422,554

(22) Filed: Apr. 13, 2009

(65) Prior Publication Data

US 2009/0257786 A1 Oct. 15, 2009

(30) Foreign Application Priority Data

Apr. 15, 2008 (JP) ..... 2008-105461

(51) Int. Cl.
*G03G 15/08* (2006.01)

(52) U.S. Cl. ..... 399/265; 399/266

(58) Field of Classification Search ..... 399/119, 399/252, 258, 265–271
See application file for complete search history.

(56) References Cited

U.S. PATENT DOCUMENTS 6,658,227 B2 12/2003 Oyama et al.
6,721,534 B2 4/2004 Takahashi
6,856,780 B2 2/2005 Kadota et al.
6,947,682 B2 9/2005 Kosugi et al.
7,123,864 B2 * 10/2006 Miyaguchi et al. ..... 399/254
7,212,753 B2 5/2007 Suzuki et al.
7,308,222 B2 12/2007 Nakagawa et al.
7,313,336 B2 12/2007 Kadota et al.
7,340,204 B2 3/2008 Nakazato et al.
7,359,660 B2 4/2008 Nakazato et al.
7,412,190 B2 8/2008 Kadota et al.
7,734,233 B2 * 6/2010 Aoki et al. ..... 399/266
7,747,203 B2 * 6/2010 Nishiwaki et al. ..... 399/265
2006/0216071 A1 9/2006 Yamada et al.
2006/0251449 A1 11/2006 Takahashi et al.
2007/0013924 A1 1/2007 Sakai et al.
2007/0015071 A1 1/2007 Tsukamoto et al.
2007/0086811 A1 4/2007 Tsukamoto et al.
2007/0160395 A1 7/2007 Kosugi et al.
2007/0212121 A1 9/2007 Takahashi et al.
2007/0242985 A1 10/2007 Aoki et al.
2008/0089720 A1 4/2008 Tsukamoto et al.
2008/0089723 A1 4/2008 Tsukamoto et al.
2008/0124138 A1 5/2008 Kosugi et al.
2008/0286015 A1 11/2008 Kadota et al.
2009/0016781 A1 1/2009 Takahashi et al.
2009/0035025 A1 2/2009 Ishii et al.
2009/0067889 A1 3/2009 Nakagawa et al.

(Continued)

FOREIGN PATENT DOCUMENTS

JP 2002-351218 12/2002

(Continued)

*Primary Examiner* — Hoan Tran
(74) *Attorney, Agent, or Firm* — Oblon, Spivak, McClelland, Maier & Neustadt, L.L.P.

(57) ABSTRACT

A developing device includes a toner carrying member and an electric-field forming unit. The electric-field forming unit forms electric fields having different characteristics at a first area of the surface of the toner carrying member located within a developing area and a second area of the surface of the toner carrying member located out of the developing area such that a hopping height of toner at the first area is higher than that at the second area.

11 Claims, 14 Drawing Sheets

U.S. PATENT DOCUMENTS

| | | | |
|---|---|---|---|
| 2009/0074431 | A1 | 3/2009 | Aoki et al. |
| 2009/0022523 | A1 | 7/2009 | Kadota et al. |

FOREIGN PATENT DOCUMENTS

| | | |
|---|---|---|
| JP | 2004-198675 | 7/2004 |
| JP | 2007-133376 | 5/2007 |
| JP | 2007-133387 | 5/2007 |
| JP | 2007-133388 | 5/2007 |
| JP | 2007-133389 | 5/2007 |
| JP | 2007-133390 | 5/2007 |
| JP | 2008-8929 | 1/2008 |
| JP | 2008-122427 | 5/2008 |
| JP | 2008-122428 | 5/2008 |

* cited by examiner

DEVELOPING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document 2008-105461 filed in Japan on Apr. 15, 2008.

BACKGROUND OF THE INVENTION

1. Field of the Invention

The present invention relates to a developing device that develops a latent image formed on a latent-image carrying member by applying toner hopping on a surface of a toner carrying member to the latent image, a process cartridge, and an image forming apparatus.

2. Description of the Related Art

A developing device that develops a latent image formed on a latent-image carrying member by applying toner hopping on a surface of a cylindrical toner carrying member to the latent image is disclosed in Japanese Patent Application Laid-open No. 2007-133389. A plurality of long electrodes each extending in the axial direction is arranged on the toner carrying member in the circumferential direction at a predetermined pitch. An alternating electric field is formed between the adjacent electrodes on the surface of the toner carrying member. The toner moves back and forth between the adjacent electrodes by hopping in accordance with change in a direction of the alternating electric field. The toner repeatedly hops between the adjacent electrodes while the toner is conveyed to a developing area where the toner carrying member is opposed to a latent-image carrying member in accordance with the rotation of the toner carrying member. When the toner hops from the surface of the toner carrying member at the developing area and floats near the surface of the latent-image carrying member, the toner is attracted by an electric field formed by the latent image whereby the toner adheres to the latent image. In this manner, a toner image is formed on the surface of the latent-image carrying member.

In a conventional developing device, toner is conveyed to a developing area such that the toner is moved in a certain direction by hopping on a surface of a toner carrying member, instead of conveying the toner to the developing area in accordance with the surface movement of the toner carrying member while the toner is hopping between the electrodes. For example, Japanese Patent Application Laid-open No. 2004-198675 discloses a developing device that employs a toner carrying member on which three electrode, a A-phase electrode, a B-phase electrode, and a C-phase electrode are repeatedly arranged in this order. The toner is caused to hop on the surface of the toner carrying member sequentially from the A-phase electrode to the B-phase electrode, from the B-phase electrode to the C-phase electrode, and from the C-phase electrode to the A-phase electrode, so that the toner is conveyed to a developing area.

Such a developing device employing a system in which the hopping toner is used for development (hereinafter, "the hopping system") makes it possible to develop an image with a low electric potential, which cannot be achieved in a conventional one-component developing system or a conventional two-component developing system. In the hopping system, for example, the toner can selectively adhere to an electrostatic latent image having a potential difference of only several tens of volts (V) from a non-image area formed around the electrostatic latent image.

However, an insufficient hopping height of the toner on the surface of the toner carrying member causes development failure of an isolated dot. Specifically, if the hopping height of the toner is lower at the developing area, a distance between the toner hopping on the surface of the toner carrying member and the surface of the latent-image carrying member is larger. As a result, it is difficult for the toner to adhere to the electrostatic latent image formed on the surface of the latent-image carrying member. A relatively high electric field is formed at an area where a plurality of image dots is arranged in series on the surface of the latent-image carrying member due to a plurality of latent images corresponding to the image dots. Therefore, even if the distance between the toner hopping on the surface of the toner carrying member and the surface of the latent-image carrying member is relatively large because of the relatively low hopping height of the toner at the developing area, the toner can be attracted by the electric field whereby the toner can adhere to the latent images. However, the intensity of the electric field is not so high at an area where only one image dot is present in an isolated manner on the surface of the latent-image carrying member. Therefore, if the hopping height of the toner is relatively low at the developing area, the toner is not properly attracted by the electric field, resulting in development failure of the isolated dot.

If the intensity of the electric field formed on the surface of the toner carrying member is high enough to obtain a sufficient hopping height of the toner, the isolated dot can be developed in an improved manner. However, the toner hopping high on the surface of the toner carrying member is easily splattered by falling out of the electric field due to an air current, inertia, a surrounding environment, or the like. Especially, the toner is easily splattered because the toner falls out of the electric field formed between the electrodes at ends on the surface of the toner carrying member in a direction perpendicular to a direction in which the electrodes are arranged even if the hopping direction of the toner slightly shifts from the direction in which the electrodes are arranged.

Japanese Patent Application Laid-open No. 2002-351218 discloses a developing device in which the toner is prevented from splattering from the surface of the toner carrying member. Specifically, the developing device includes, as a toner carrying member, a flat board on which a plurality of rectangular electrodes each extending in a width direction of the flat board is arranged at a predetermined pitch in a longitudinal direction of the flat board. The developing device causes the toner to sequentially move from one end to the other end of the flat board in the longitudinal direction by hopping, so that the toner is conveyed to a developing area. An electrode substrate is opposed to an area other than the developing area on the surface of the toner carrying member with a predetermined gap. The electrode substrate limits a hopping height of the toner, so that it is possible to prevent the splattering of the toner due to a high hopping height of the toner. Because ends of the electrode substrate in its width direction are curved toward the toner carrying member, a distance between the electrode substrate and the toner carrying member is smaller at the ends than at a middle area in the width direction. With this configuration, an electric field formed at the ends of the surface of the toner carrying member in the width direction is oriented in a direction from the ends toward the middle area. Thus, when the toner is about to move from above the toner carrying member outward by hopping, the toner is attracted by the electric field at the ends of the toner carrying member in the width direction and moved back to an area above the toner carrying member whereby the splattering of the toner in the width direction is prevented. With the developing device having the above configuration, even if the intensity of the electric field is relatively high enough to develop the isolated dot in a proper manner, it is possible to prevent the splattering of the toner.

However, the arrangement of the electrode substrate makes the configuration of the developing device complicated. Especially, if the cylindrical toner carrying member is employed as described in Japanese Patent Application Laid-open No. 2007-133389, the outer surface of the cylindrical toner carrying member is covered with the electrode substrate, resulting in poor maintenance performance.

SUMMARY OF THE INVENTION

It is an object of the present invention to at least partially solve the problems in the conventional technology.

According to one aspect of the present invention, there is provided a developing device including a toner carrying member that includes a plurality of electrodes arranged in a predetermined direction and carries toner on its surface; and an electric-field forming unit that forms an electric field on a surface of the toner carrying member by applying a voltage to at least a part of the electrodes. The electric-field forming unit forms electric fields having different characteristics at a first area on the surface of the toner carrying member located within a developing area and a second area on the surface of the toner carrying member located out of the developing area such that a hopping height of the toner at the first area is higher than that at the second area.

Furthermore, according to another aspect of the present invention, there is provided a process cartridge for an image forming apparatus that includes a latent-image carrying member that carries a latent image, a charging unit that charges the latent-image carrying member, a developing unit that develops the latent image thereby forming a toner image on a surface of the latent-image carrying member, a transferring unit that transfers the toner image from the surface of the latent-image carrying member to a transfer member, and a cleaning unit that, after the transferring unit transfers the toner image to the transfer member, removes residual toner from the surface of the latent-image carrying member. The process cartridge includes the developing unit and at least one of the latent-image carrying member, the charging unit supported by a common supporting member as a single unit, so that the process cartridge can be installed in a detachable in the image forming apparatus in an integrated manner. The developing unit includes a toner carrying member that includes a plurality of electrodes arranged in a predetermined direction and carries toner on its surface, and an electric-field forming unit that forms an electric field on a surface of the toner carrying member by applying a voltage to at least a part of the electrodes. The electric-field forming unit forms electric fields having different characteristics at a first area on the surface of the toner carrying member located within a developing area and a second area on the surface of the toner carrying member located out of the developing area such that a hopping height of the toner at the first area is higher than that at the second area.

Moreover, according to still another aspect of the present invention, there is provided an image forming apparatus including a latent-image carrying member that carries a latent image and a developing unit that develops the latent image. The developing unit includes a toner carrying member that includes a plurality of electrodes arranged in a predetermined direction and carries toner on its surface, and an electric-field forming unit that forms an electric field on a surface of the toner carrying member by applying a voltage to at least a part of the electrodes. The electric-field forming unit forms electric fields having different characteristics at a first area on the surface of the toner carrying member located within a developing area and a second area on the surface of the toner carrying member located out of the developing area such that a hopping height of the toner at the first area is higher than that at the second area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Although an image forming apparatus according to an embodiment of the present invention is applied to a printer, the present invention can be applied to a copier, a scanner, a facsimile, or a multifunction product (MFP).

Figure 1:
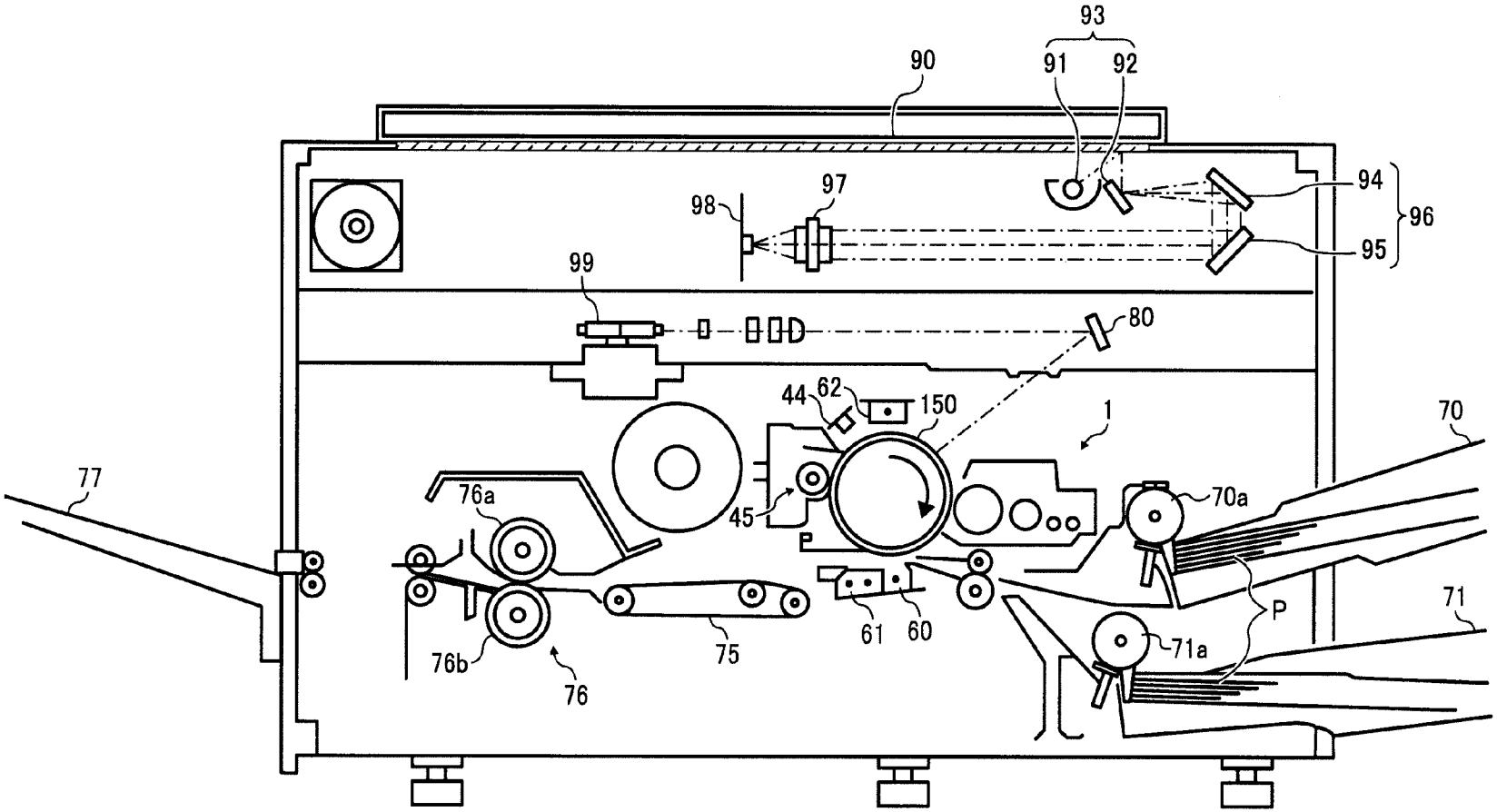
FIG. 1 is a schematic diagram of an image forming apparatus according to an embodiment of the present invention.

FIG. 1 is a schematic diagram of an image forming apparatus according to an embodiment of the present invention. The image forming apparatus has the configuration as described below. A drum-shaped photosensitive element 150 serving as a latent-image carrying member is a well-known organic photosensitive element, and is rotated in a clockwise direction shown in FIG. 1 by a drive unit (not shown).

When a user places an original (not shown) on an exposure glass 90 and presses a switch (not shown) for starting a print operation, a first scanning optical system 93 and a second scanning optical system 96 are driven so that a scanning operation is performed on an image of the original. The first scanning optical system 93 includes an original illumination source 91 and a mirror 92, and the second scanning optical system 96 includes mirrors 94 and 95.

The scanned image of the original is read as an image signal by an image reading device 98 arranged near the back side of a lens 97. The image signal is digitized and then subjected to image processing. A laser diode (LD) (not shown) is driven to emit a laser light based on the processed signal, the emitted laser light is reflected by a polygon mirror 99, and then the photosensitive element 150 is irradiated with the laser light via a mirror 80. Before the photosensitive element 150 is irradiated with the laser light, the outer surface of the photosensitive element 150 is uniformly charged by a charging device 62, so that an electrostatic latent image is formed on the outer surface of the photosensitive element 150 with the laser light.

A developing device 1 transfers toner to the electrostatic latent image thereby forming a toner image on the outer surface of the photosensitive element 150. The toner image is then conveyed to a transfer position where the photosensitive element 150 is opposed to a transfer charger 60 in accordance with the rotation of the photosensitive element 150. A first feed unit 70 including a first feed roller 70*a* or a second feed unit 71 including a second feed roller 71*a* feeds a recording medium P to the transfer position in synchronization with the toner image formed on the surface of the photosensitive element 150. The toner image formed on the surface of the photosensitive element 150 is transferred onto the recording medium P by corona discharge from the transfer charger 60.

After the toner image is transferred onto the recording medium P, the recording medium P is separated from the outer surface of the photosensitive element 150 by corona discharge from a separation charger 61 and then conveyed toward a fixing device 76 by a conveying belt 75. In the fixing device 76, the recording medium P is conveyed into a fixing nip where a fixing roller 76*a* including a heat source (not shown) such as a halogen lamp is in contact with a pressure roller 76*b* that is pressed against the fixing roller 76*a*. After the toner image is fixed to the surface of the recording medium P with the pressure and the heat in the fixing nip, the recording medium P is discharged to a catch tray 77 arranged out of the image forming apparatus.

After the toner image is transferred onto the recording medium P at the transfer position, residual toner is removed from the outer surface of the photosensitive element 150 by a cleaning device 45. The outer surface of the photosensitive element 150 is then neutralized by a neutralization lamp 44, so that the photosensitive element 150 stands by for the next operation of forming an electrostatic latent image.

The photosensitive element 150 includes an organic photosensitive layer having a thickness of 13 μm. The organic photosensitive layer is uniformly charged to a level within a range of −300 V to −500 V by the charging device 62 whereby a uniform background area is formed. The background area is irradiated with a laser light with a resolution of 1200 dots per inch (dpi) whereby an electrostatic latent image is formed. An electric potential of the electrostatic latent image is within a range of about 0 V to about −50 V.

Figure 2:
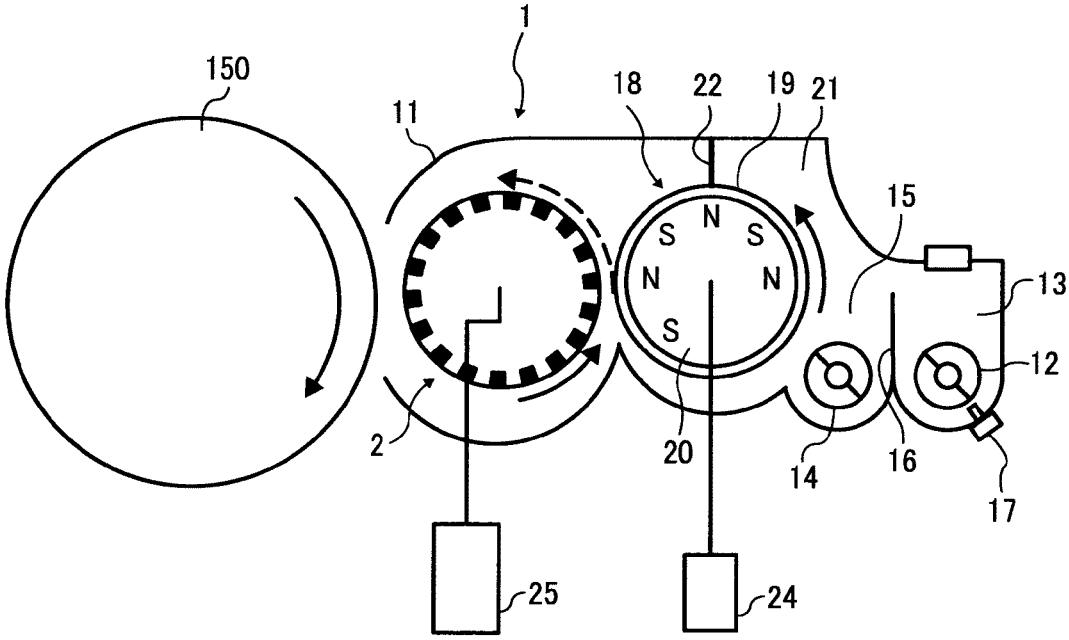
FIG. 2 is a schematic diagram for explaining a photosensitive element and a developing device shown in FIG. 1.

FIG. 2 is a schematic diagram for explaining the photosensitive element 150 and the developing device 1. The developing device 1 including a cylindrical toner carrying roller 2 serving as a toner carrying member is arranged on the right side of the photosensitive element 150 as shown in FIG. 2.

The developing device 1 includes a first container 13 and a second container 15. The first container 13 includes a first conveying screw 12 that is rotated in a clockwise direction shown in FIG. 2. The second container 15 includes a second conveying screw 14 that is rotated in a counterclockwise direction shown in FIG. 2. The first container 13 and the second container 15 are partitioned by a partition wall 16. Each of the first container 13 and the second container 15 contains a developer including a magnetic carrier (not shown) and negatively charged toner (not shown) in a mixed manner.

The first conveying screw 12 is rotated to stir the developer contained in the first container 13 while the first conveying screw 12 conveys the developer from the front side to the rear side of the first container 13 in a direction perpendicular to a sheet surface of FIG. 2. While the developer is conveyed by the first conveying screw 12, a toner density sensor 17 attached to the bottom of the first container 13 detects toner density of the developer. When the developer is conveyed to an area near the end of the first container 13 on the rear side, the developer passes through a first continuous hole (not shown) arranged near the end of the partition wall 16 on the rear side whereby the developer reaches the second container 15.

The second container 15 is connected to a magnetic-brush forming section 21 including a toner supply roller 18, and the second conveying screw 14 and the toner supply roller 18 are arranged in parallel to each other in the axial direction with a predetermined gap interposed therebetween. The second conveying screw 14 is rotated to stir the developer contained in the second container 15 while the second conveying screw 14 conveys the developer from the rear side to the front side of the second container 15 in the direction perpendicular to the sheet surface of FIG. 2. While the developer is conveyed by the second conveying screw 14, a part of the developer is carried by a cylindrical toner supply sleeve 19 made of a nonmagnetic material included in the toner supply roller 18. After the developer passes through a toner supply area that will be described later in accordance with the rotation of the toner supply sleeve 19 in the counterclockwise direction shown in FIG. 2, the developer is separated from the surface of the toner supply sleeve 19 and then returned to the second container 15. The developer is then conveyed to an area near the end of the second container 15 on the front side by the second conveying screw 14 and returned to the first container 13 through a second continuous hole (not shown) arranged near the end of the partition wall 16 on the front side.

The toner density sensor 17 is a permeability sensor. A detection result of permeability of the developer obtained by the toner density sensor 17 is sent as a voltage signal to a control unit (not shown) included in the printer. Because the permeability of the developer is correlated with toner density of the developer, the toner density sensor 17 outputs a voltage value corresponding to the toner density.

The control unit includes a random access memory (RAM) (not shown) that stores therein a target value Vtref of a voltage output from the toner density sensor 17. A value of a voltage output from the toner density sensor 17 is compared with the target value Vtref stored in the RAM, and a toner supply device (not shown) is driven during a period determined based on a comparison result. Thus, an appropriate amount of toner is supplied to the first container 13 in which the toner density of the developer is decreased due to consumption of the toner by a developing operation. In this manner, the toner density of the developer contained in the second container 15 can be maintained within a predetermined range.

The toner supply roller 18 further includes a magnet roller 20 that is not rotated together with the toner supply sleeve 19. The toner supply sleeve 19 is made of a nonmagnetic material such as aluminum, brass, stainless steel, or conductive resin. As shown in FIG. 2, the magnet roller 20 has a plurality of magnetic poles arranged in the rotation direction of the toner supply sleeve 19. Specifically, six magnetic poles, i.e., the north pole, the south pole, the north pole, the south pole, the north pole, and the south pole are sequentially arranged in the counterclockwise direction from the twelve o'clock position shown in FIG. 2. The magnetic poles cause the developer to adhere to the outer surface of the toner supply sleeve 19, and developer particles are arranged along a magnetic line in a standing manner whereby the developer particles form a magnetic brush.

The developer carried on the surface of the toner supply sleeve 19 is conveyed in the counterclockwise direction shown in FIG. 2 in accordance with the rotation of the toner supply sleeve 19. The developer then reaches an adjustment position where the toner supply sleeve 19 is opposed to an adjustment member 22 with a predetermined gap between the surface of the toner supply sleeve 19 and the edge of the adjustment member 22. The developer passes through the gap, so that an amount of the developer carried on the surface of the toner supply sleeve 19 is adjusted at the adjustment position.

The toner carrying roller 2 arranged on the left side of the toner supply sleeve 19 as shown in FIG. 2 is rotated in the counterclockwise direction shown in FIG. 2 by a drive unit (not shown) while the toner carrying roller 2 is opposed to the toner supply roller 18 with a predetermined gap interposed between the surface of the toner carrying roller 2 and the surface of the toner supply sleeve 19.

After the developer passes through the adjustment position in accordance with the rotation of the toner supply sleeve 19, the developer reaches the toner supply area where the developer is in contact with the toner carrying roller 2 and is moved such that the edge of the magnetic brush slides on the surface of the toner carrying roller 2. The toner carried by the magnetic brush is supplied to the surface of the toner carrying roller 2 due to the slide of the magnetic brush or a potential difference between the toner supply sleeve 19 and the toner carrying roller 2. A supply bias is applied from a supply-bias power source 24 to the toner supply sleeve 19. The supply bias can be a direct-current (DC) voltage having the same polarity as that of the charged toner, or can be a voltage obtained by superimposing an alternating-current (AC) voltage on a DC voltage.

After the magnetic brush passes through the toner supply area, the magnetic brush is conveyed to an opposed position where the toner supply sleeve 19 is opposed to the second container 15 in accordance with the rotation of the toner supply sleeve 19. Because the magnet roller 20 does not have a magnetic pole near the opposed position and therefore magnetic force for attracting the developer to the surface of the toner supply sleeve 19 does not act near the opposed position, the developer is separated from the surface of the toner supply sleeve 19 and is returned to the second container 15.

Although it is explained above that the magnet roller 20 has the six magnetic poles in the printer according to the embodiment, the number of the magnetic poles is not limited to six. The magnet roller 20 can have 8 or 12 magnetic poles.

A portion of the outer surface of the toner carrying roller 2 is exposed through an opening arranged on a casing 11 included in the developing device 1. The exposed portion is opposed to the photosensitive element 150 with a gap of several tens of μm to several hundreds of μm interposed therebetween. An area where the toner carrying roller 2 is directly opposed to the photosensitive element 150 is defined as a developing area in the printer according to the embodiment.

The toner supplied to the surface of the toner carrying roller 2 hops on the surface of the toner carrying roller 2 for a reason described later, while the toner is conveyed from the toner supply area to the developing area in accordance with the rotation of the toner carrying roller 2. The toner adheres to the electrostatic latent image formed on the outer surface of the photosensitive element 150 at the developing area whereby a toner image is formed on the outer surface of the photosensitive element 150.

Figure 3:
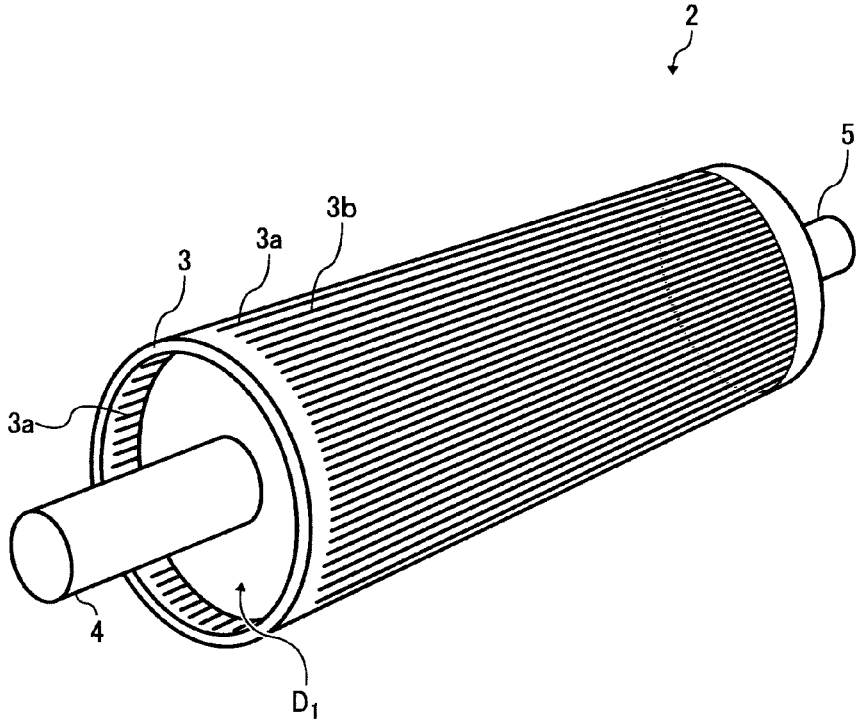
FIG. 3 is a perspective view of a toner carrying roller shown in FIG. 2 as seen from one end of the toner carrying roller in its axial direction.

FIG. 3 is a perspective view of the toner carrying roller 2 as seen from one end of the toner carrying roller 2 in its axial direction. The toner carrying roller 2 includes a roller portion 3 and shaft members 4 and 5 that are protruded from end surfaces of the roller portion 3 in its axial direction. A plurality of electrodes each extending in the axial direction of the toner carrying roller 2 is formed around the outer surface of the roller portion 3 in parallel to one another at a predetermined pitch in a circumferential direction (rotation direction) of the roller portion 3. The electrodes that are in the same potential state and are in phase are alternately arranged in the circumferential direction. Specifically, an A-phase electrode **3*a* and a B-phase electrode 3*b* are alternately arranged in the circumferential direction. Although each of the A-phase electrode 3*a* and the B-phase electrode 3*b* extends over most areas on the outer surface of the roller portion 3 in the axial direction, the A-phase electrode 3*a* and the B-phase electrode 3*b* do not extend to edges of the roller portion 3** in the axial direction.

The toner carrying roller 2 is rotated in the developing device 1 such that the shaft members 4 and 5 are rotatably supported. As shown in FIG. 3, a circular depressed area D1 is formed on a first end of the roller portion 3 in the axial direction. The depressed area D1 is formed from the edge toward the middle area of the roller portion 3 in the axial direction. Although not shown, a depressed area D2 is formed on a second end of the roller portion 3 in the same manner.

Figure 4:
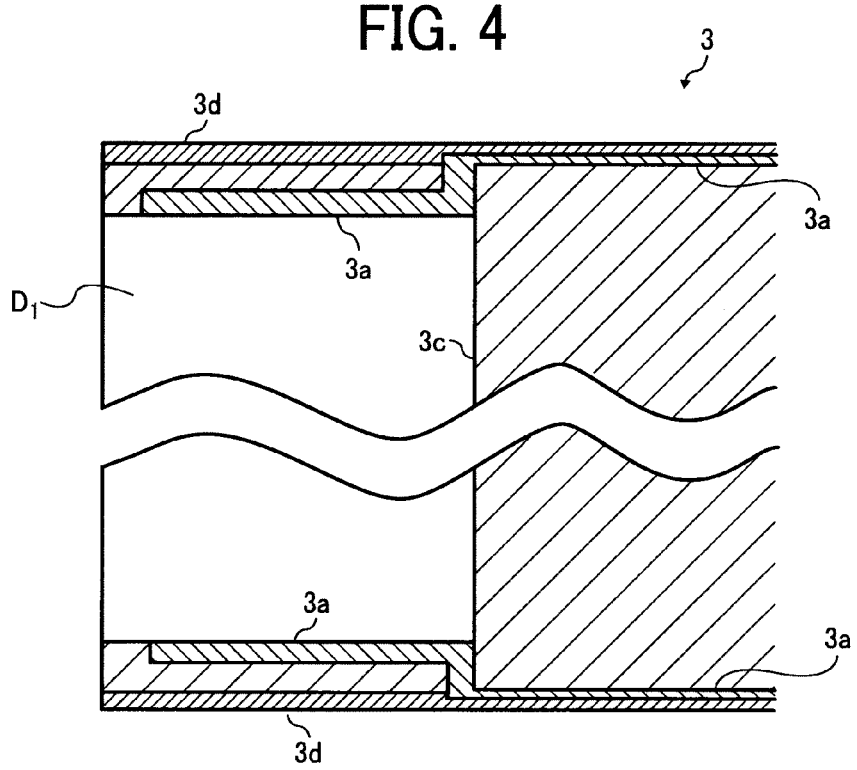
FIG. 4 is a longitudinal sectional view of a first end of a roller portion shown in FIG. 3 in its axial direction taken along a line where an A-phase electrode shown in FIG. 3 is formed.

FIG. 4 is a longitudinal sectional view of the first end of the roller portion 3 in the axial direction taken along a line where the A-phase electrode 3*a* is formed. The surface of the roller portion 3 is coated with a surface protecting layer 3*d* made of an insulating material. The A-phase electrode 3*a* is formed between a surface of a cylindrical roller base 3*c* made of acrylic resin or the like and the surface protecting layer 3*d*. Although the A-phase electrode 3*a* extends from the middle area toward the edge on the surface of the roller base 3*c* in the axial direction at the first end, the A-phase electrode 3*a* does not extend to the edge on the surface of the roller base 3*c*. The A-phase electrode 3*a* penetrates inside of the roller base 3*c* in the middle area and reaches the inner surface of the depressed area D1. The A-phase electrode 3*a* then extends from the middle area toward the edge on the inner surface of the depressed area D1 in the axial direction. Although the A-phase electrode 3*a* is coated with the surface protecting layer 3*d* on the surface of the roller base 3*c*, the A-phase electrode 3*a* is not coated with a protecting layer on the inner surface of the depressed area D1 and the surface of the A-phase electrode 3*a* is exposed to outside.

Figure 5:
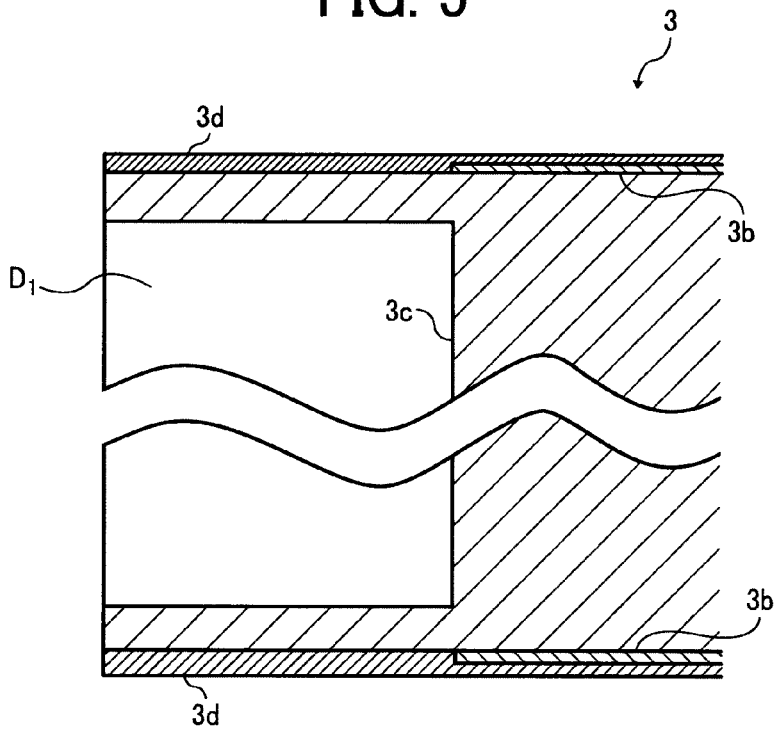
FIG. 5 is a longitudinal sectional view of the first end of the roller portion in the axial direction taken along a line where a B-phase electrode shown in FIG. 3 is formed.

FIG. 5 is a longitudinal sectional view of the first end of the roller portion 3 in the axial direction taken along a line where the B-phase electrode 3*b* is formed. Although the A-phase electrode 3*a* is formed on the inner surface of the depressed area D1, the B-phase electrode 3*b* is not formed on the inner surface of the depressed area D1 at the first end of the roller portion 3. The B-phase electrode 3*b* is formed on the surface of the roller base 3*c* at the first end.

Figure 6:
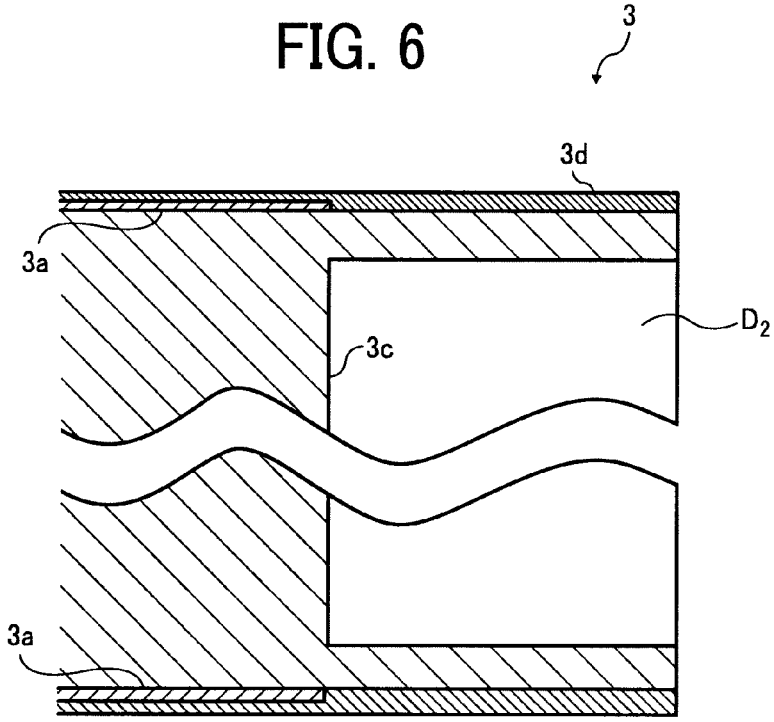
FIG. 6 is a longitudinal sectional view of a second end of the roller portion in the axial direction taken along a line where the A-phase electrode is formed.

FIG. 6 is a longitudinal sectional view of the second end of the roller portion 3 in the axial direction taken along a line where the A-phase electrode 3*a* is formed. The A-phase electrode 3*a* is not formed on the inner surface of the depressed area D2 at the second end of the roller portion 3. The A-phase electrode 3*a* is formed on the surface of the roller base 3*c* at the second end.

Figure 7:
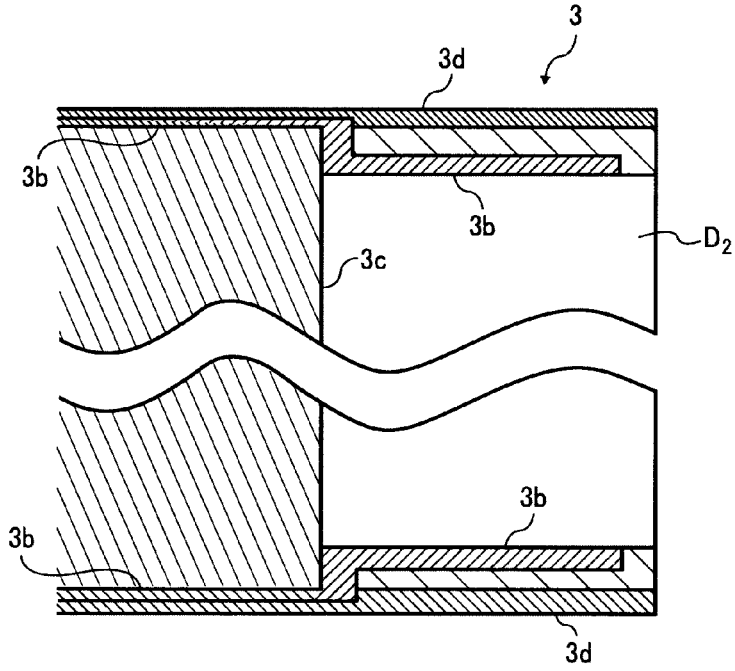
FIG. 7 is a longitudinal sectional view of the second end of the roller portion in the axial direction taken along a line where the B-phase electrode is formed.

FIG. 7 is a longitudinal sectional view of the second end of the roller portion 3 in the axial direction taken along a line where the B-phase electrode 3*b* is formed. Although the B-phase electrode 3*b* extends from the middle area toward the edge on the surface of the roller base 3*c* in the axial direction at the second end of the roller portion 3, the B-phase electrode 3*b* does not extend to the edge on the surface of the roller base 3*c*. The B-phase electrode 3*b* penetrates inside of the roller base 3*c* in the middle area and reaches the inner surface of the depressed area D2. The A-phase electrode 3*a* then extends from the middle area toward the edge on the inner surface of the depressed area D2 in the axial direction. Although the B-phase electrode 3*b* is coated with the surface protecting layer 3*d* on the surface of the roller base 3*c*, the B-phase electrode 3*b* is not coated with a protecting layer on the inner surface of the depressed area D1 and the surface of the B-phase electrode 3*b* is exposed to outside.

Figure 8:
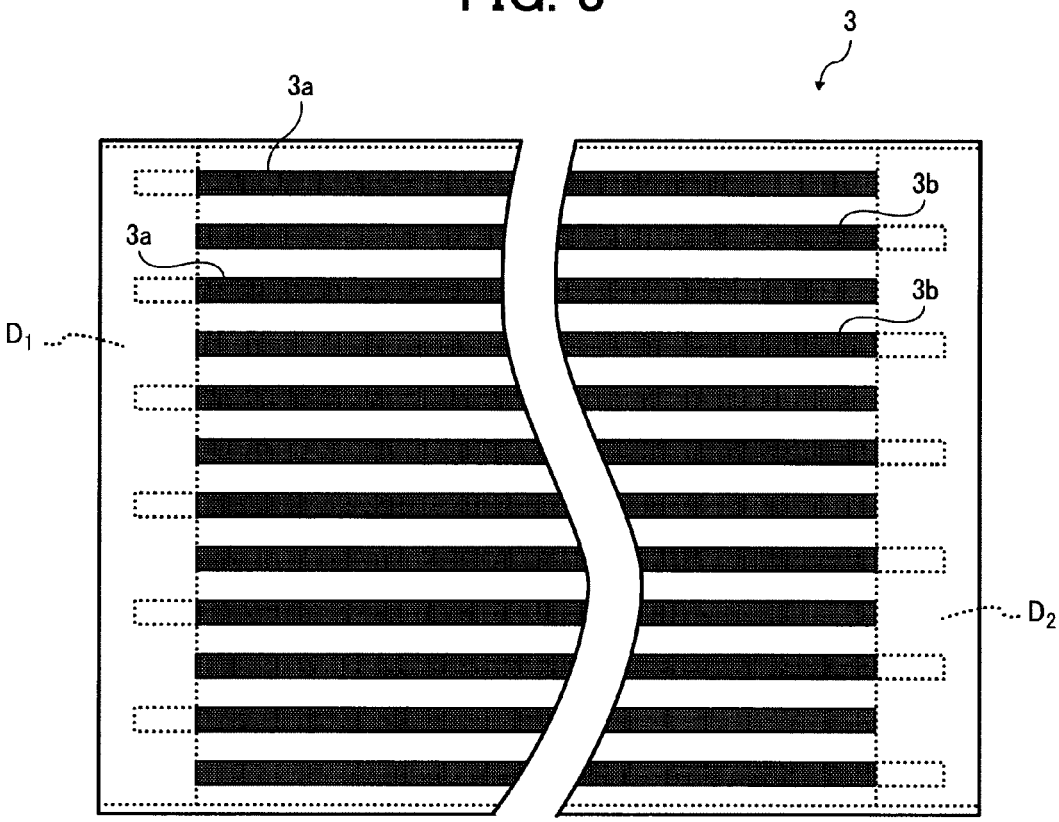
FIG. 8 is a planar development view of the roller portion.

FIG. 8 is a planar development view of the roller portion 3. The A-phase electrode 3*a* extends on the inner surface of the depressed area D1 at the first end of the roller portion 3, while the B-phase electrode 3*b* does not extend on the inner surface of the depressed area D1 at the first end. On the other hand, the B-phase electrode 3*b* extends on the inner surface of the depressed area D2 at the second end of the roller portion 3, while the A-phase electrode 3*a* does not extend on the inner surface of the depressed area D2 at the second end.

Figure 9:
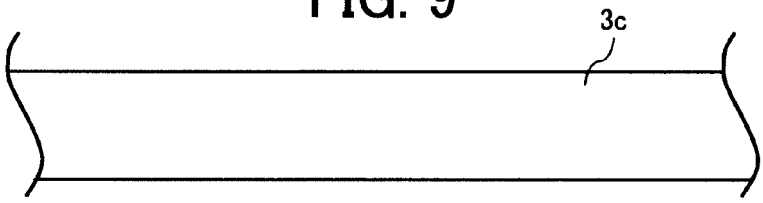
FIGS. 9 to 13 are schematic diagrams for explaining a process of manufacturing the roller portion.
Figure 10:
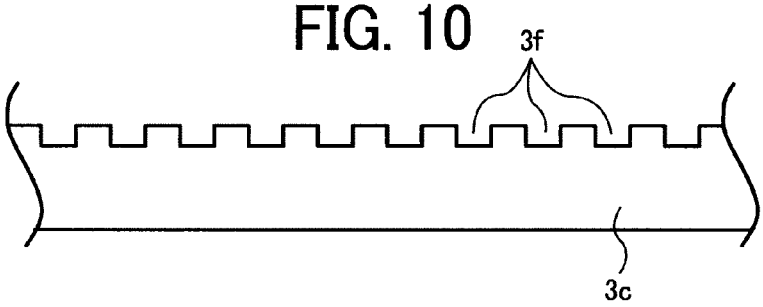
Figure 11:
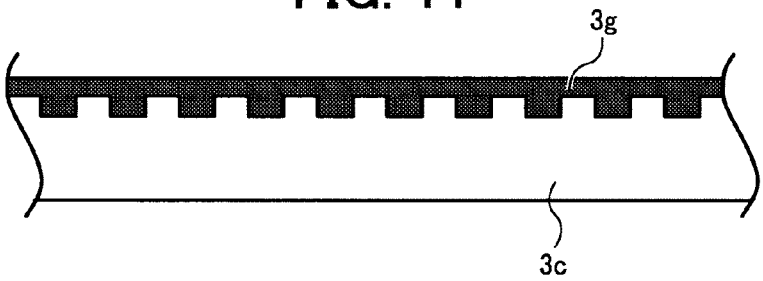
Figure 12:
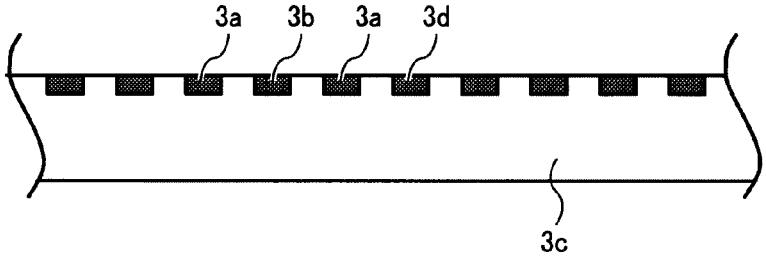
Figure 13:
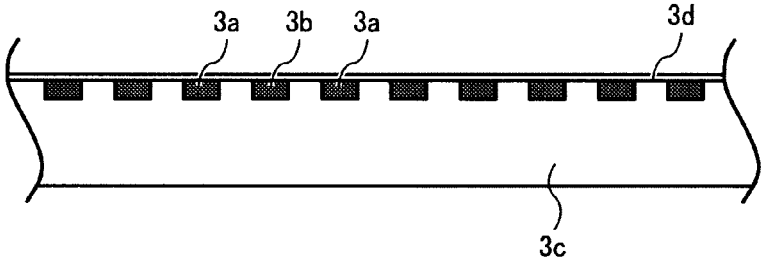

The A-phase electrodes 3*a* and the B-phase electrodes 3*b* are formed on the surface of the roller base 3*c* in a manner as described below. FIGS. 9 to 13 are schematic diagrams for explaining a process of manufacturing the roller portion 3. Specifically, a cutting process is performed on the surface of the roller base 3*c* as shown in FIG. 9, so that a plurality of grooves 3*f* each extending in the axial direction is formed on the surface of the roller base 3*c* at a predetermined pitch in the circumferential direction as shown in FIG. 10. The groove 3*f* has a width of about 50 μm, and the grooves 3*f* are arranged at a pitch of about 100 μm in the circumferential direction. As shown in FIG. 11, an electroless nickel plating process is performed on the surface of the roller base 3*c* whereby a plated layer 3*g* is formed on the surface of the roller base 3*c*. The plated layer 3*g* is spread in the inside of each of the grooves 3*f*, and the surface of the roller base 3*c* is coated with the plated layer 3*g* having a predetermined thickness. A portion of the plated layer 3*g* that is not formed inside the grooves 3*f* is removed by a cutting process, so that the A-phase electrodes 3*a* and the B-phase electrodes 3*b* are separately formed in the grooves 3*f* in a fixed manner as shown in FIG. 12. Afterward, the surfaces of the roller base 3*c*, the A-phase electrodes 3*a*, and the B-phase electrodes 3*b* are coated with silicone-series resin whereby the surface protecting layer 3*d* having a thickness of about 5 μm and a volume resistivity of about $10^{10}$ Ω·cm is formed as shown in FIG. 13.

The A-phase electrodes 3*a* and the B-phase electrodes 3*b* are formed on the depressed areas D1 and D2 in the same manner as described above. However, the A-phase electrodes 3*a* and the B-phase electrodes 3*b* are not coated with a protecting layer on the depressed areas D1 and D2.

Figure 14:
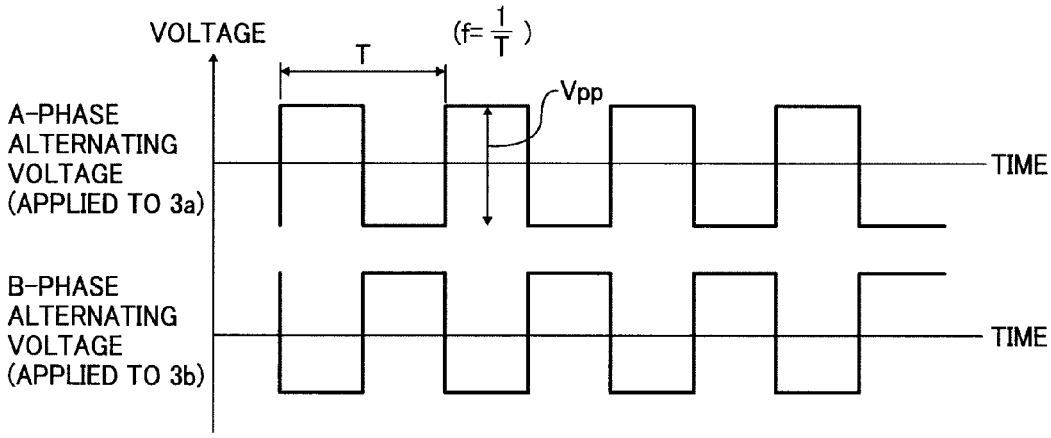
FIG. 14 is a waveform chart for explaining characteristics of an A-phase alternating voltage applied to the A-phase electrodes and a B-phase alternating voltage applied to the B-phase electrodes.

FIG. 14 is a waveform chart for explaining characteristics of an A-phase alternating voltage applied to the A-phase electrode 3*a* and a B-phase alternating voltage applied to the B-phase electrode 3*b*. Phases of the A-phase alternating voltage and the B-phase alternating voltage are opposite to each other, and average electric potentials of the A-phase alternating voltage and the B-phase alternating voltage are the same per unit time. When the A-phase alternating voltage and the B-phase alternating voltage are applied to the A-phase electrode 3*a* and the B-phase electrode 3*b*, toner is caused to repeatedly hop on the surface of the roller portion 3 such that the toner moves back and forth between the A-phase electrode 3*a* and the B-phase electrode 3*b*. In the following description, a state in which the toner repeatedly hops on the surface of the roller portion 3 in a predetermined cycle is referred to as flare (flare phenomenon).

It is preferable that a peak-to-peak voltage (hereinafter, "Vpp") of each of the A-phase alternating voltage and the B-phase alternating voltage is set within a range of 100 V to 1000 V. This is because if the Vpp is less than 100 V, an alternating electric field having sufficient intensity cannot be formed between the A-phase electrode 3*a* and the B-phase electrode 3*b*, resulting in improper hopping of the toner. Moreover, if the Vpp is more than 1000 V, electric discharge can occur between the A-phase electrode 3*a* and the B-phase electrode 3*b*. If the electric discharge occurs, the alternating electric field cannot be formed between the A-phase electrode 3*a* and the B-phase electrode 3*b*, which stops the hopping of the toner.

It is preferable that a frequency f of each of the A-phase alternating voltage and the B-phase alternating voltage is set within a range of 0.1 kilohertz (kHz) to 10 kHz. This is because if the frequency f is less than 0.1 kHz, a speed at which the toner moves back and forth between the A-phase electrode 3*a* and the B-phase electrode 3*b* by hopping cannot catch up with a developing speed. Moreover, if the frequency f is more than 10 kHz, the hopping of the toner cannot catch up with a speed at which a direction of the alternating electric field between the A-phase electrode 3*a* and the B-phase electrode 3*b* is changed over.

A center value of each of the A-phase alternating voltage and the B-phase alternating voltage is set to a value between an electric potential of an electrostatic latent image formed on the photosensitive element 150 and an electric potential of the background area.

Because a polarity of the alternating voltage having a rectangular waveform shown in FIG. 14 is changed instantaneously, it is possible to apply large electrostatic force to the toner. Alternatively, an alternating voltage having a sine waveform or a triangular waveform can be used.

Figure 15:
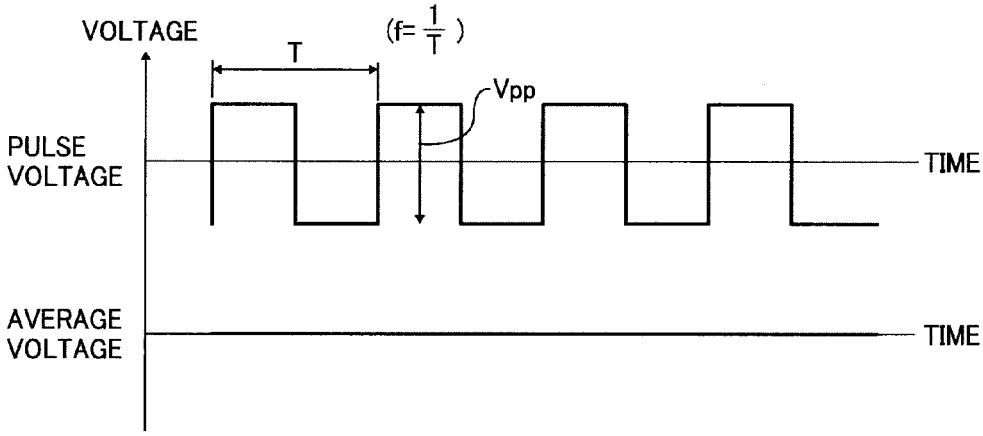
FIG. 15 is a waveform chart for explaining characteristics of voltages applied to electrodes in another example.

FIG. 15 is a waveform chart for explaining characteristics of voltages applied to electrodes in another example. If a pulse voltage having the frequency f and a rectangular waveform is applied to a first shaft member (electrode) while a DC voltage having an average potential of the pulse voltage is applied to a second shaft member (electrode), the flare phenomenon can occur in the same manner as when the pulse voltages having opposite phases are applied to the electrodes. In such a case, because the largest potential difference between the electrodes is half of the Vpp, it is preferable that the Vpp of the pulse voltage is set within a range of 200 V to 2000 V that is twice as large as those of the A-phase alternating voltage and the B-phase alternating voltage. Because it is not necessary to cause the two alternating voltages to have opposite phases to each other, costs for electric power supply can be reduced.

When the toner repeatedly moves back and forth between the A-phase electrode 3*a* and the B-phase electrode 3*b* by hopping on the surface of the roller portion 3 whereby the flare is generated on the surface of the roller portion 3, the toner is conveyed to the developing area in accordance with the rotation of the toner carrying roller 2. If the toner hops from the surface of the roller portion 3 in a parabolic trajectory at the developing area and reaches near the electrostatic latent image formed on the photosensitive element 150 on the top of the parabolic trajectory, the toner is attracted by electrostatic force generated by the electrostatic latent image thereby departing from the trajectory, so that the toner adheres to the electrostatic latent image. On the other hand, if the toner reaches near the background area of the photosensitive element 150 on the top of the parabolic trajectory, the toner goes down without departing from the trajectory and arrives at the surface of the toner carrying roller 2.

The toner that is released from the surface of the roller portion 3 by hopping is used for developing the electrostatic latent image, so that it is possible to develop the image with a low electric potential, which cannot be achieved in the one-component developing system or the two-component developing system employing a developing roller and a developing sleeve.

As shown in FIG. 2, the toner that has not transferred onto the surface of the photosensitive element 150 for development at the developing area is returned to the casing 11 in accordance with the rotation of the toner carrying roller 2 and then reaches the toner supply area. Because the toner is released from the surface of the roller portion 3 by hopping at the toner supply area, the toner is easily removed or uniformly spread by the magnetic brush that slides in the counter direction against the toner carrying roller 2. Concurrently, toner is supplied from the magnetic brush to the toner carrying roller 2. A combination of the operations of removing, uniformly spreading, and supplying the toner makes it possible to cause a uniform amount of toner to hop on the surface of the toner carrying roller 2 after the toner passes through the toner supply area.

The A-phase alternating voltage and the B-phase alternating voltage shown in FIG. 14 are applied to the A-phase electrode 3*a* and the B-phase electrode 3*b* from a conveying power source 25 shown in FIG. 2. Thus, the electric field for hopping the toner is generated on the surface of the toner carrying roller 2. The conveying power source 25 and slide electrodes 50, 52, 54, and 56 that apply a voltage output from the conveying power source 25 to each of the electrodes 3*a* and 3*b* function as a electric-field generating unit that generates an electric field on the surface of the toner carrying roller 2 by applying the output voltage to the A-phase electrode 3*a* and the B-phase electrode 3*b*.

Figure 16:
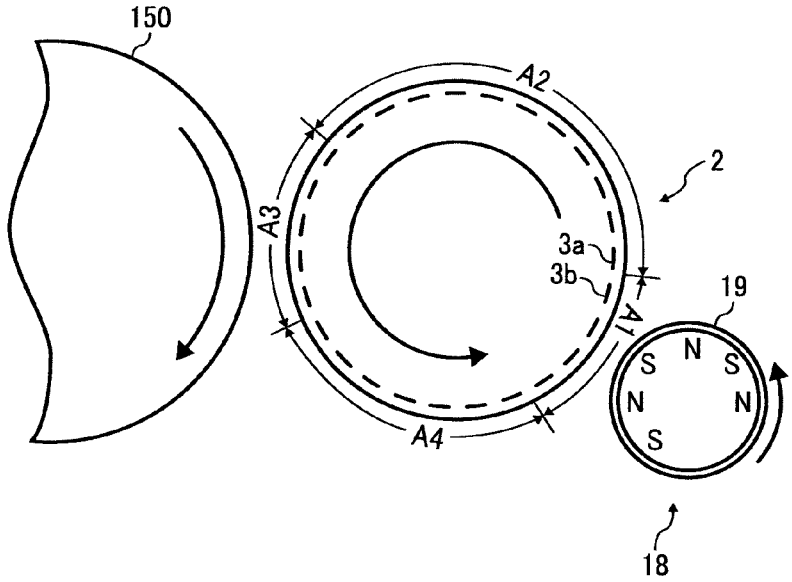
FIG. 16 is a schematic diagram for explaining divided areas on a surface of the roller portion.

FIG. 16 is a schematic diagram for explaining divided areas on the surface of the roller portion 3. Four areas are arranged on the surface of the roller portion 3 in the circumferential direction. Specifically, a toner supply area A1, a pre-development conveying area A2, a developing area A3, and a post-development conveying area A4 are sequentially arranged in the rotation direction of the toner carrying roller 2. The surface of the roller portion 3 sequentially passes through the areas A1 to A4 in accordance with the rotation of the toner carrying roller 2.

The toner supply area A1 is an area where the roller portion 3 is opposed to the toner supply roller 18. Specifically, the toner supply area A1 is an area where the roller portion 3 is opposed to an area on the outer surface of the toner supply roller 18 to which the toner adheres when the rotation of the toner carrying roller 2 is stopped and the alternating voltages are not applied to the electrodes 3*a* and 3*b* while the voltage is applied to the toner supply roller 18. At the toner supply area A1, the toner contained in the developer carried on the surface of the toner supply sleeve 19 is supplied to the surface of the roller portion 3.

As described above, the developing area A3 is an area where the photosensitive element 150 is opposed to the roller portion 3. At the developing area A3, the toner hopping on the surface of the roller portion 3 is transferred onto the surface of the photosensitive element 150 for development. Specifically, the developing area A3 is an area where a solid electrostatic latent image formed on the photosensitive element 150 is developed when the photosensitive element 150 is opposed to the toner carrying roller 2 and the rotation of the photosensitive element 150 is stopped while the toner carrying roller 2 having the surface on which the flare is generated is rotated.

The pre-development conveying area A2 is located between the toner supply area A1 and the developing area A3 in the rotation direction of the toner carrying roller 2. The post-development conveying area A4 is located between the developing area A3 and the toner supply area A1 in the rotation direction of the toner carrying roller 2.

Figure 17:
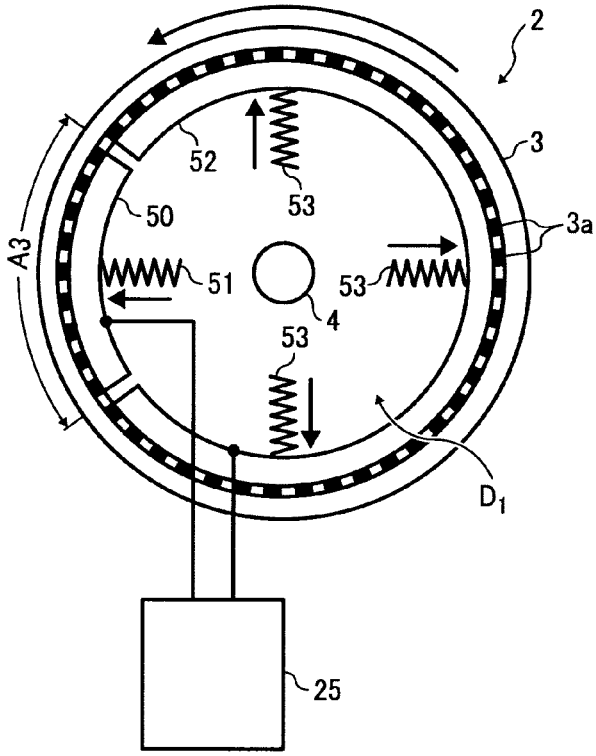
FIG. 17 is a front view of the toner carrying roller as seen from the first end of the roller portion in the axial direction.

FIG. 17 is a front view of the toner carrying roller 2 as seen from the first end of the roller portion 3 in the axial direction. As described above, the depressed area D1 is formed at the first end of the roller portion 3. The A-phase electrode 3*a* extends from the outer surface of the roller portion 3 to the inner surface of the depressed area D1 in the axial direction. The A-phase first slide electrode 50 and the A-phase second slide electrode 52 are arranged on the depressed area D1 such that the A-phase first slide electrode 50 and the A-phase second slide electrode 52 do not rotate together with the roller portion 3. Different A-phase alternating voltages are applied to the A-phase first slide electrode 50 and the A-phase second slide electrode 52 from the conveying power source 25.

The A-phase first slide electrode 50 is biased toward the inner surface of the depressed area D1 by a coil spring 51 serving as a biasing unit such that the A-phase first slide electrode 50 slides on an area of the inner surface of the depressed area D1 located at a first opposed position that is opposed to the developing area A3. Thus, an A-phase alternating voltage for developing an image (hereinafter, "first A-phase alternating voltage") is applied to the A-phase electrode 3*a* that reaches the first opposed position in accordance with the rotation of the roller portion 3 via the A-phase first slide electrode 50 from the conveying power source 25.

The A-phase second slide electrode 52 is biased toward the inner surface of the depressed area D1 by three coil springs 53 such that the A-phase second slide electrode 52 slides on an area of the inner surface of the depressed area D1 located at a second opposed position that is opposed to the areas other than the developing area A3. Thus, an A-phase alternating voltage for conveying the toner (hereinafter, "second A-phase alternating voltage") is applied to the A-phase electrode 3*a* that reaches the second opposed position in accordance with the rotation of the roller portion 3 via the A-phase second slide electrode 52 from the conveying power source 25.

Although each of the first A-phase alternating voltage and the second A-phase alternating voltage has the phase opposite to that of the B-phase alternating voltage like the A-phase alternating voltage shown in FIG. 14, the first A-phase alternating voltage and the second A-phase alternating voltage have slightly different characteristics. Specifically, compared with the second A-phase alternating voltage, the first A-phase alternating voltage has characteristics that the hopping height of the toner is higher.

Figure 18:
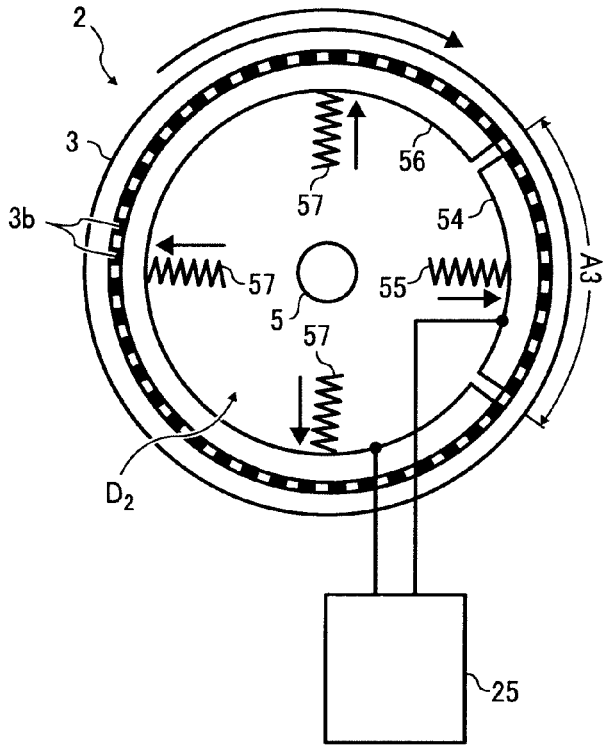
FIG. 18 is a front view of the toner carrying roller as seen from the second end of the roller portion in the axial direction.

FIG. 18 is a front view of the toner carrying roller 2 as seen from the second end of the roller portion 3 in the axial direction. As described above, the depressed area D2 is formed at the second end of the roller portion 3. The B-phase electrode 3*b* extends from the outer surface of the roller portion 3 to the inner surface of the depressed area D2 in the axial direction. The B-phase first slide electrode 54 and the B-phase second slide electrode 56 are arranged on the depressed area D2 such that the B-phase first slide electrode 54 and the B-phase second slide electrode 56 are not rotated together with the roller portion 3. Different B-phase alternating voltages are applied to the B-phase first slide electrode 54 and the B-phase second slide electrode 56 from the conveying power source 25.

The B-phase first slide electrode 54 is biased toward the inner surface of the depressed area D2 by a coil spring 55 such that the B-phase first slide electrode 54 slides on an area of the inner surface of the depressed area D2 located at the first opposed position. Thus, a B-phase alternating voltage for developing an image (hereinafter, "first B-phase alternating voltage") is applied to the B-phase electrode 3*b* that reaches the first opposed position in accordance with the rotation of the roller portion 3 via the B-phase first slide electrode 54 from the conveying power source 25.

The B-phase second slide electrode 56 is biased toward the inner surface of the depressed area D2 by three coil springs 57 such that the B-phase second slide electrode 56 slides on an area of the inner surface of the depressed area D2 located at the second opposed position. Thus, a B-phase alternating voltage for conveying the toner (hereinafter, "second B-phase alternating voltage") is applied to the B-phase electrode 3*b* that reaches the second opposed position in accordance with the rotation of the roller portion 3 via the B-phase second slide electrode 56 from the conveying power source 25.

Although each of the first B-phase alternating voltage and the second B-phase alternating voltage has the phase opposite to that of the A-phase alternating voltage like the B-phase alternating voltage shown in FIG. 14, the first B-phase alternating voltage and the second B-phase alternating voltage have slightly different characteristics. Specifically, compared with the second B-phase alternating voltage, the first B-phase alternating voltage has characteristics that the hopping height of the toner is higher.

The electric-field generating unit has the configuration as described below. Electric fields having different characteristics are formed on a first area of the outer surface of the roller portion 3 located within the developing area A3 and a second area of the outer surface of the roller portion 3 located out of the developing area A3. A hopping height of the toner at the first area is higher than that at the second area.

The electric field having characteristics that a sufficient hopping height of the toner can be obtained is formed at the first area of the roller portion 3, so that an isolated dot on the photosensitive element 150 can be developed in an improved manner. On the other hand, the electric field having characteristics that a relatively low hopping height of the toner is obtained is formed at the second area of the roller portion 3, so that splattering of the toner from the surface of the roller portion 3 is prevented. Thus, it is possible to prevent the development failure of the isolated dot and the splattering of the toner without arranging the electrode substrate as described in Japanese Patent Application Laid-open No. 2002-351218.

The electric field in which a higher hopping height of the toner can be obtained means an electric field having larger intensity in a direction normal to the surface of the roller portion 3.

In the following description, unless otherwise stated, an image forming apparatus according to each example has the same configuration as that of the image forming apparatus according to the embodiment.

In an image forming apparatus according to a first example of the present invention, the conveying power source 25 applies, as the second A-phase alternating voltage, an alternating voltage having a waveform of the A-phase alternating voltage shown in FIG. 14 to the A-phase electrode 3*a* located at the second opposed position. Moreover, the conveying power source 25 applies, as the first A-phase alternating voltage, an alternating voltage having the same phase and the same frequency f as those of the second A-phase alternating voltage and the Vpp higher than that of the second A-phase alternating voltage to the A-phase electrode 3*a* that reaches the first opposed position. The conveying power source 25 applies, as the second B-phase alternating voltage, an alternating voltage having a waveform of the B-phase alternating voltage shown in FIG. 14 to the B-phase electrode 3*b* located at the second opposed position. Moreover, the conveying power source 25 applies, as the first B-phase alternating voltage, an alternating voltage having the same phase and the same frequency f as those of the second B-phase alternating voltage and the Vpp higher than that of the second B-phase alternating voltage to the B-phase electrode 3*b* that reaches the first opposed position. The first A-phase alternating voltage and the first B-phase alternating voltage have the same Vpp. The second A-phase alternating voltage and the second B-phase alternating voltage have the same Vpp.

With the above configuration, the electric field in which the hopping height of the toner at the developing area A3 is higher than that at the areas other than the developing area A3 can be formed on the surface of the roller portion 3. Specifically, intensity of the electric field formed on the surface of the roller portion 3 at the developing area A3 in the direction normal to the surface of the roller portion 3 is larger than that of the electric field at the areas other than the developing area A3.

The inventor(s) of the present invention manufactured a test apparatus having the same configuration as that of the image forming apparatus according to the first example. In the test apparatus, each of the A-phase electrode 3*a* and the B-phase electrode 3*b* had a width of 40 μm in the circumferential direction. The A-phase electrode 3*a* and the B-phase electrode 3*b* were arranged at a pitch of 40 μm that is the same as the width. The roller portion 3 had a diameter of 30 μm. A developing gap between the surface of the photosensitive element 150 and the surface of the roller portion 3 at the developing area A3 was set to 0.3 millimeters (mm).

The test apparatus having the above configuration printed out a test image by applying the first A-phase alternating voltage, the first B-phase alternating voltage, the second A-phase alternating voltage, and the second B-phase alternating voltage, the frequency f of which was set to 1 kHz. Each of the photosensitive element 150 and the toner carrying roller 2 was rotated at a linear velocity of 180 mm/sec. An electric potential of the background area of the photosensitive element 150 was set to about −400 V, and an electric potential of an electrostatic latent image formed by optical writing was decreased to −50 V. A resolution of the electrostatic latent image was set to 600 dpi. A particle diameter of the toner was adjusted to 5 μm.

The test image was printed out under three conditions as shown in Table 1, and development performance of the isolated dot and suppression performance of splattering of the toner were examined under each of the conditions. When an isolated dot was developed with desired image density, an evaluation for the development performance was "Good", and when the isolated dot was developed with density lower than the desired image density or if the isolated dot failed to be developed, the evaluation for the development performance was "Bad". The suppression performance was evaluated as described below. Specifically, when the test image was printed out, a blank sheet was placed just under the toner carrying roller 2, the toner carrying roller 2 was rotated 360 degrees while the toner hopped on the surface of the toner carrying roller 2, and then the operation of the test apparatus was stopped. Afterward, the blank sheet was examined for dirt on the surface of the sheet caused due to the toner. When the dirt was not recognized on the blank sheet, an evaluation for the suppression performance was "Good", and when the dirt was recognized on the blank sheet, the evaluation for the suppression performance was "Bad". As shown in Table 1, "alternating voltage for development" means the first A-phase alternating voltage and the first B-phase alternating voltage, and "alternating voltage for conveyance" means the second A-phase alternating voltage and the second B-phase alternating voltage.

TABLE 1

| | Vpp of alternating voltage for development | Vpp of alternating voltage for conveyance | Development performance of isolated dot | Suppression performance of splattering of toner |
|---|---|---|---|---|
| Condition 1 | 400 V | 400 V | Good | Bad |
| Condition 2 | 200 V | 200 V | Bad | Good |
| Condition 3 | 400 V | 400 V | Good | Good |

The evaluation for the development performance was "Good" under Condition 1. When the alternating voltage having the Vpp of 400 V (200 V) was applied to the electrode located within the developing area A3, a sufficient hopping height of the toner was obtained at the developing area A3 whereby the isolated dot was developed with sufficient density. However, the alternating voltage having the Vpp of 400 V was also applied to the electrode located at the areas other than the developing area A3. Therefore, the evaluation for the suppression performance was "Bad" under Condition 1. Thus, if the hopping height of the toner at the areas other than the developing area A3 is the same as that at the developing area A3, splattering of the toner is caused.

The evaluation for the suppression performance was "Good" under Condition 2. When the alternating voltage having the Vpp of 200 V (±100 V) was applied to the electrode located at the areas other than the developing area A3, it was possible to prevent the splattering of the toner. However, because the alternating voltage having the Vpp of 200 V was also applied to the electrode located within the developing area A3, it was difficult to obtain a sufficient hopping height of the toner at the developing area A3, resulting in development failure of the isolated dot.

In the same manner as the image forming apparatus according to the first example, the Vpp of the alternating voltage for development was higher than that of the alternating voltage for conveyance under Condition 3. Specifically, the Vpp of the alternating voltage for development was set to 400 V, while the Vpp of the alternating voltage for conveyance was set to 200 V. With this configuration, a sufficient hopping height of the toner was obtained at the developing area A3 whereby the isolated dot was developed with sufficient density, while a relatively low hopping height of the toner was obtained at the areas other than the developing area A3 whereby the splattering of the toner was effectively prevented.

The conveying power source 25 changes the Vpp of each of the first A-phase alternating voltage and the first B-phase alternating voltage independently of the alternating voltages for conveyance if a predetermined condition is satisfied, for example, if an amount of change in temperature or humidity based on a detection result of a sensor (not shown) exceeds a predetermined amount. With this configuration, when the hopping characteristics of the toner changes due to the change in temperature or humidity, the Vpp of each of the first A-phase alternating voltage and the first B-phase alternating voltage is changed based on the amount of the change in temperature or humidity, so that it is possible to obtain the hopping height of the toner at the developing area A3 in a stable manner.

Furthermore, the conveying power source 25 changes the Vpp of each of the second A-phase alternating voltage and the second B-phase alternating voltage independently of the alternating voltages for development if a predetermined condition is satisfied, for example, if an amount of change in temperature or humidity based on a detection result of the sensor exceeds a predetermined amount. With this configuration, when the hopping characteristics of the toner changes due to the change in temperature or humidity, the Vpp of each of the second A-phase alternating voltage and the second B-phase alternating voltage is changed based on the amount of change in temperature or humidity, so that it is possible to obtain the hopping height of the toner at the areas other than the developing area A3 in a stable manner.

In an image forming apparatus according to a second example of the present invention, the conveying power source 25 applies, as the second A-phase alternating voltage, an alternating voltage having a waveform of the A-phase alternating voltage shown in FIG. 14 to the A-phase electrode 3*a* located at the second opposed position. Moreover, the conveying power source 25 applies, as the first A-phase alternating voltage, an alternating voltage having the same Vpp as that of the second A-phase alternating voltage and the frequency f lower than that of the second A-phase alternating voltage to the A-phase electrode 3*a* that reaches the first opposed position. The conveying power source 25 applies, as the second B-phase alternating voltage, an alternating voltage having a waveform of the B-phase alternating voltage shown in FIG. 14 to the B-phase electrode 3*b* located at the second opposed position. Moreover, the conveying power source 25 applies, as the first B-phase alternating voltage, an alternating voltage having the same Vpp as that of the second B-phase alternating voltage and the frequency f lower than that of the second B-phase alternating voltage to the B-phase electrode 3*b* that reaches the first opposed position. The first A-phase alternating voltage and the first B-phase alternating voltage have the same frequency f, and phases of the waveforms of the first A-phase alternating voltage and the first B-phase alternating voltage are synchronized with each other. The second A-phase alternating voltage and the second B-phase alternating voltage have the same frequency f, and phases of the waveforms of the second A-phase alternating voltage and the second B-phase alternating voltage are synchronized with each other.

With the above configuration, the electric field in which the hopping height of the toner at the developing area A3 is higher than that at the areas other than the developing area A3 can be formed on the surface of the roller portion 3. Specifically, intensity of the electric field formed on the surface of the roller portion 3 at the developing area A3 in the direction normal to the surface of the roller portion 3 is larger than that of the electric field at the areas other than the developing area A3. The reason for this is that if the frequency f of the alternating voltage is high, the toner moves back and forth between the electrodes by hopping in a shorter cycle, resulting in a lower hopping height of the toner. On the other hand, if the frequency f of the alternating voltage is low, the toner moves back and forth between the electrodes by hopping in a longer cycle, resulting in a higher hopping height of the toner.

The test image was printed out by using the test apparatus under three conditions as shown in Table 2, and the development performance and the suppression performance were examined under each of the conditions in the same manner as shown in Table 1. The Vpp of each of the first A-phase alternating voltage, the second A-phase alternating voltage, the first B-phase alternating voltage, and the second B-phase alternating voltage was set to 300 V.

TABLE 2

| | Frequency of alternating voltage for development | Frequency of alternating voltage for conveyance | Development performance of isolated dot | Suppressing performance of splattering of toner |
|---|---|---|---|---|
| Condition A | 0.5 kHz | 0.5 kHz | Good | Bad |
| Condition B | 5 kHz | 5 kHz | Bad | Good |
| Condition C | 0.5 kHz | 5 kHz | Good | Good |

The evaluation for the development performance was "Good" under Condition A. If the alternating voltage having the Vpp of 300 V and the frequency f of 0.5 kHz was applied to the electrode located within the developing area A3, a sufficient hopping height of the toner was obtained at the developing area A3 whereby the isolated dot was developed with sufficient density. However, the alternating voltage having the Vpp of 300 V and the frequency f of 0.5 kHz was also applied to the electrode located at the areas other than the developing area A3. Therefore, the evaluation for the suppression performance was "Bad" under Condition A. As described above, if the hopping height of the toner at the areas other than the developing area A3 is the same as that at the developing area A3, the splattering of the toner is caused.

The evaluation for the suppression performance was "Good" under Condition B. If the alternating voltage having the Vpp of 300 V and the frequency f of 5 kHz was applied to the electrode located at the areas other than the developing area A3, it was possible to prevent the splattering of the toner. However, because the alternating voltage having the Vpp of 300 V and the frequency f of 5 kHz was also applied to the electrode located within the developing area A3, it was difficult to obtain a sufficient hopping height of the toner at the developing area A3, resulting in development failure of the isolated dot.

In the same manner as the image forming apparatus according to the second example, the frequency f of the alternating voltage for development was lower than that of the alternating voltage for conveyance under Condition C. Specifically, the frequency f of the alternating voltage for development was set to 0.5 kHz, while the frequency f of the alternating voltage for conveyance was set to 5 kHz. With this configuration, a sufficient hopping height of the toner was obtained at the developing area A3 whereby the isolated dot was developed with sufficient density, while a relatively low hopping height of the toner was obtained at the areas other than the developing area A3 whereby the splattering of the toner was effectively prevented.

The conveying power source 25 changes the frequency f of each of the first A-phase alternating voltage and the first B-phase alternating voltage independently of the alternating voltages for conveyance if a predetermined condition is satisfied, for example, if an amount of change in temperature or humidity based on a detection result of the sensor exceeds a predetermined amount. With this configuration, when the hopping characteristics of the toner changes due to the change in temperature or humidity, the frequency f of each of the first A-phase alternating voltage and the first B-phase alternating voltage is changed based on the amount of the change in temperature or humidity, so that it is possible to obtain the hopping height of the toner at the developing area A3 in a stable manner.

Furthermore, the conveying power source 25 changes the frequency f of each of the second A-phase alternating voltage and the second B-phase alternating voltage independently of the alternating voltages for development if a predetermined condition is satisfied, for example, if an amount of change in temperature or humidity based on a detection result of the sensor exceeds a predetermined amount. With this configuration, when the hopping characteristics of the toner changes due to the change in temperature or humidity, the frequency f of each of the second A-phase alternating voltage and the second B-phase alternating voltage is changed based on the amount of the change in temperature or humidity, so that it is possible to obtain the hopping height of the toner at the areas other than the developing area A3 in a stable manner.

In the following description, unless otherwise stated, an image forming apparatus according to each modification has the same configuration as that of the image forming apparatuses according to the first and the second examples.

Figure 19:
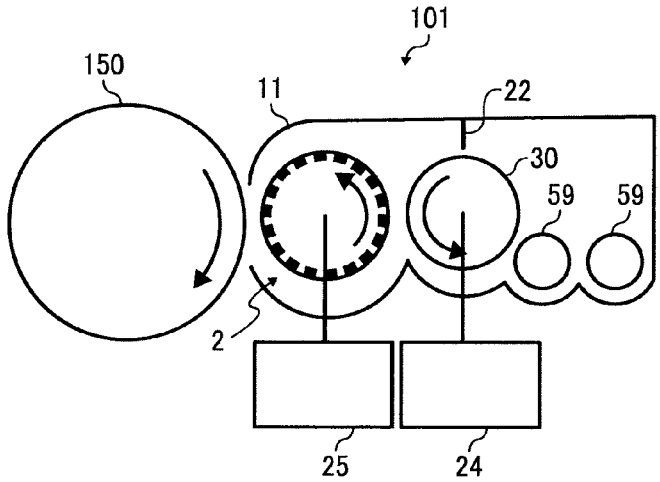
FIG. 19 is a schematic diagram for explaining the photosensitive element and a developing device included in an image forming apparatus according to a first modification of the present invention.

FIG. 19 is a schematic diagram for explaining the photosensitive element 150 and a developing device 101 included in an image forming apparatus according to a first modification of the present invention. A toner container included in the developing device 101 contains nonmagnetic toner. The nonmagnetic toner is stirred by two stirring rollers 59 that are rotated in contact with each other. The nonmagnetic toner slides at a contact area between the stirring rollers 59 whereby the nonmagnetic toner is electrically charged by friction. The charged nonmagnetic toner is carried on a surface of a rotating toner supply roller 30 included in the developing device 101. The nonmagnetic toner is then pressed against the adjustment member 22 having its free end in contact with the surface of the toner supply roller 30, so that the thickness of the nonmagnetic toner is adjusted. Afterward, the nonmagnetic toner is conveyed to a toner supply area where the toner supply roller 30 is opposed to the toner carrying roller 2 in accordance with the rotation of the toner supply roller 30.

The supply bias is applied to the toner supply roller 30 from the supply-bias power source 24. The supply bias can be a DC voltage or an AC voltage. Alternatively, it can be a voltage obtained by superimposing the AC voltage on the DC voltage. An electric field for supplying the nonmagnetic toner from the toner supply roller 30 to the toner carrying roller 2 is formed at the toner supply area due to a potential difference between an average value of an alternating voltage applied to each of the electrodes 3*a* and 3*b* and the supply bias. The electric field causes the nonmagnetic toner on the surface of the toner supply roller 30 to be transferred onto the surface of the roller portion 3.

The nonmagnetic toner supplied to the surface of the roller portion 3 at the toner supply area forms the flare on the surface of the roller portion 3 by hopping, while the nonmagnetic toner is conveyed to a developing area in accordance with the rotation of the toner carrying roller 2. A part of the nonmagnetic toner forming the flare is transferred onto the surface of the photosensitive element 150 for development at the developing area. The nonmagnetic toner that has not transferred onto the surface of the photosensitive element 150 for development is returned to the casing 11 in accordance with the rotation of the toner carrying roller 2 while the nonmagnetic toner forms the flare on the surface of the roller portion 3. The nonmagnetic toner is then removed from the surface of the roller portion 3 by a cleaning unit (not shown). The removed nonmagnetic toner is returned to the toner container, and then supplied to the surface of the roller portion 3 again.

Figure 20:
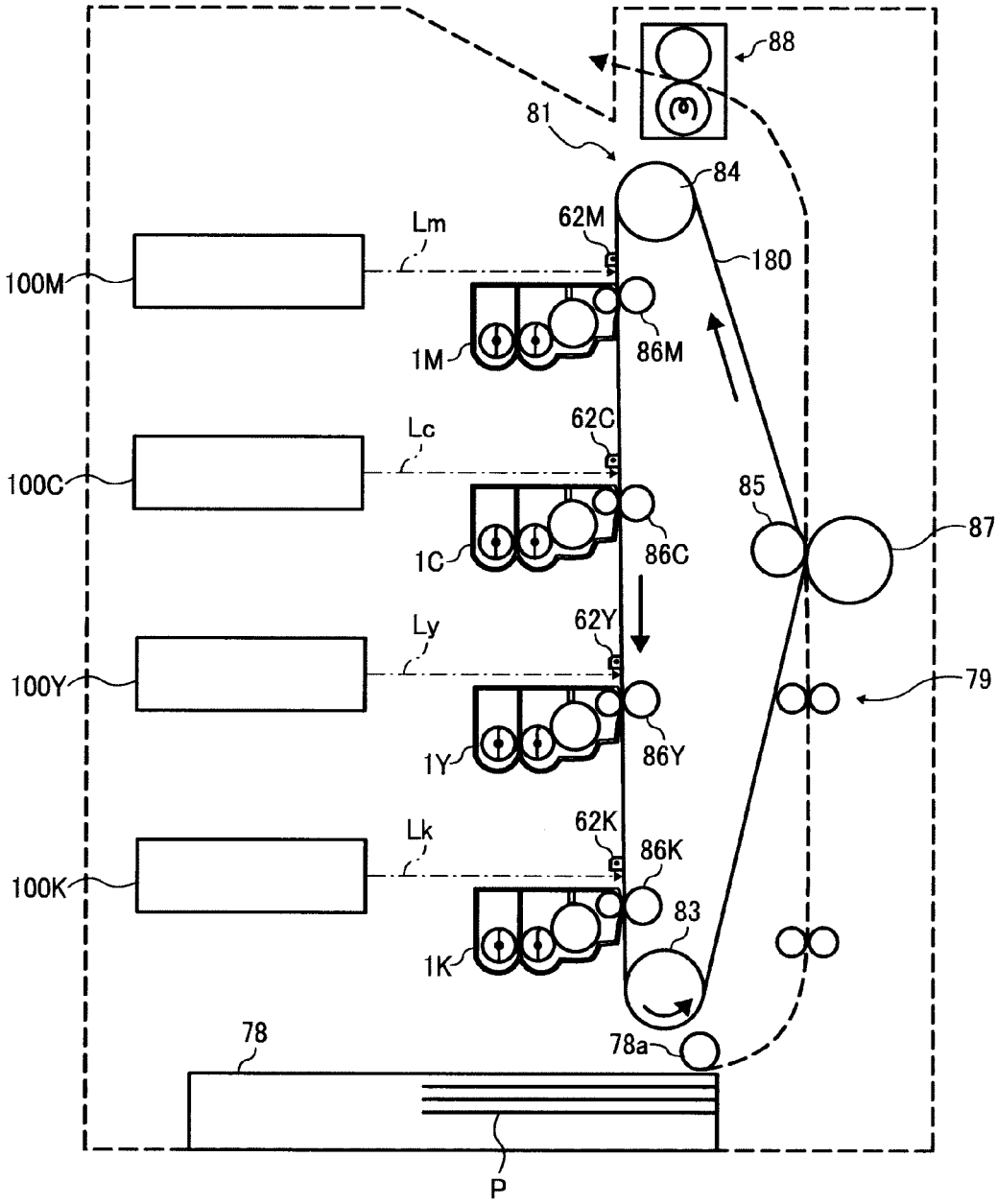
FIG. 20 is a schematic diagram for explaining an image forming apparatus according to a second modification of the present invention.

FIG. 20 is a schematic diagram for explaining an image forming apparatus according to a second modification of the present invention. The image forming apparatus can form a full-color image by transferring four toner images corresponding to four colors of cyan, magenta, yellow, and black (hereinafter, referred to as "CMYK" as appropriate) in a superimposed manner. The image forming apparatus includes a belt unit 81, four process cartridges corresponding to the CMYK colors, four optical writing units 100C, 100M, 100Y, and 100K corresponding to the CMYK colors, a pair of registration rollers 79, a transfer roller 87, a fixing device 88, and a feed cassette 78.

The belt unit 81 supports a photosensitive element 180 that is an endless belt serving as a latent-image carrying member in a longitudinal direction such that the photosensitive element 180 extends in the longitudinal direction rather than in the lateral direction, while the photosensitive element 180 is endlessly moved in the counterclockwise direction shown in FIG. 20. Specifically, the inner side of the photosensitive element 180 is supported by a drive roller 83, a supporting roller 84, a transfer backup roller 85, and four developing rollers 86C, 86M, 86Y, and 86K. The photosensitive element 180 is endlessly moved in accordance with the rotation of the drive roller 83 that is rotated by a drive unit (not shown) in the counterclockwise direction shown in FIG. 20. A supported surface (hereinafter, "left-side supported surface") of the photosensitive element 180 on the left side in FIG. 20 extends in a substantially longitudinal direction.

Figure 21:
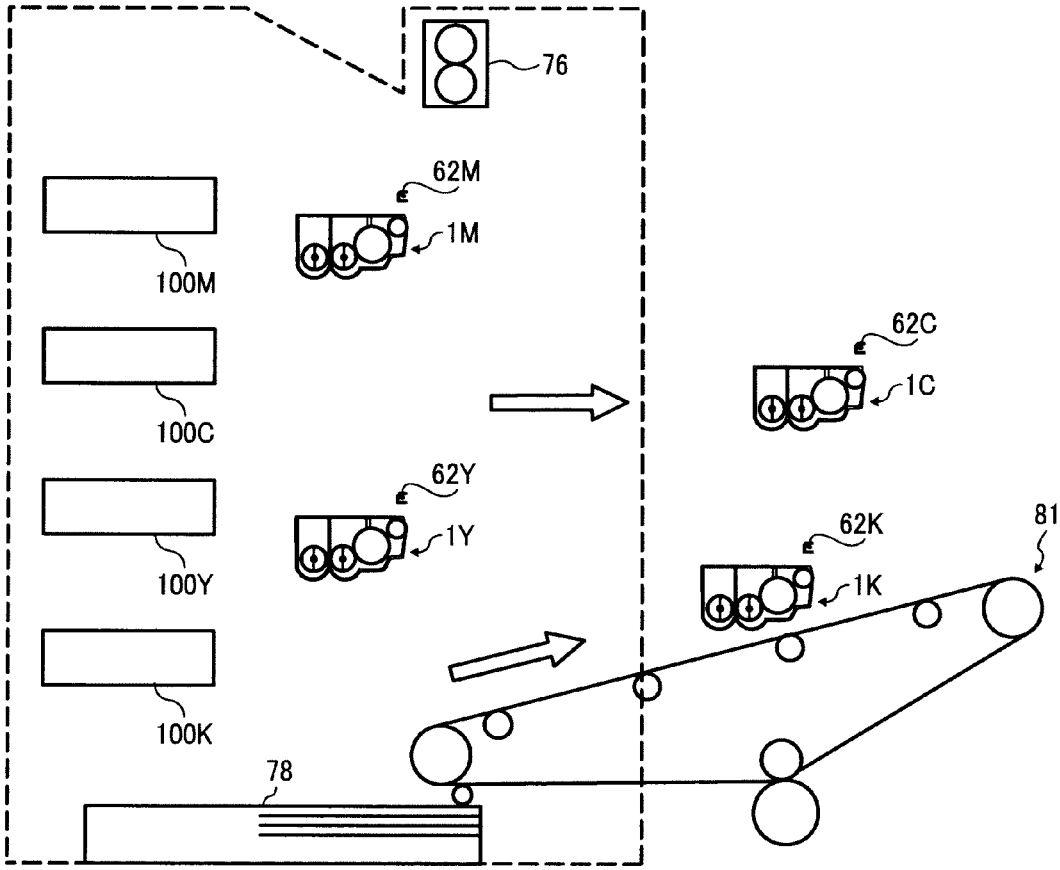
FIG. 21 is a schematic diagram of the image forming apparatus according to the second modification from which process cartridges shown in FIG. 20 are detached.

The process cartridges are arranged in the longitudinal direction on the left side of the left-side supported surface of the photosensitive element 180 in FIG. 20, and each of the process cartridges is opposed to the left-side supported surface of the photosensitive element 180. The process cartridges include developing devices 1C, 1M, 1Y, and 1K, and charging devices 62C, 62M, 62Y, and 62K that uniformly charge the photosensitive element 180. The developing devices 1C, 1M, 1Y, and 1K and the charging devices 62C, 62M, 62Y, and 62K are supported by common supporting members (not shown) as individual process cartridges. FIG. 21 is a schematic diagram of the image forming apparatus according to the second modification from which the two process cartridges are detached. The developing devices 1C, 1M, 1Y, and 1K, and the charging devices 62C, 62M, 62Y, and 62K can be attached to or detached from a printer casing in an integrated manner.

As shown in FIG. 20, the charging device 62K is arranged above the developing device 1K located at the bottom in the longitudinal direction among the developing devices 1C, 1M, 1Y, and 1K such that the charging device 62K is opposed to the left-side supported surface of the photosensitive element 180. The charging device 62Y is arranged above the developing device 1Y located right above the developing device 1K such that the charging device 62Y is opposed to the left-side supported surface of the photosensitive element 180. The charging device 62C is arranged above the developing device 1C located right above the developing device 1Y such that the charging device 62C is opposed to the left-side supported surface of the photosensitive element 180. Furthermore, the charging device 62M is arranged above the developing device 1M located right above the developing device 1C such that the charging device 62M is opposed to the left-side supported surface of the photosensitive element 180.

The optical writing units 100C, 100M, 100Y, and 100K are arranged in the longitudinal direction on the left side of the developing devices 1C, 1M, 1Y, and 1K in FIG. 20. The optical writing units 100C, 100M, 100Y, and 100K drive four laser diodes (not shown) based on image data received from an external personal computer (PC) (not shown) or an external scanner (not shown), thereby causing the laser diodes to emit laser lights Lc, Lm, Ly, and Lk corresponding to the CMYK colors. The laser lights Lc, Lm, Ly, and Lk are deflected by a polygon mirror (not shown), reflected by a reflecting mirror (not shown), and projected through an optical lens (not shown), so that the photosensitive element 180 is irradiated with the laser lights Lc, Lm, Ly, and Lk. Instead of the above configuration, the photosensitive element 180 can be irradiated with laser lights emitted from a light-emitting diode (LED) array. The photosensitive element 180 is irradiated with the laser lights Lc, Lm, Ly, and Lk in the dark.

The photosensitive element 180 is moved in a substantially straight line from upward to downward in the longitudinal direction between the supporting roller 84 located at the highest position among the rollers supporting the photosensitive element 180 and the drive roller 83 located at the lowest position among the rollers. When the photosensitive element 180 passes through a position where the photosensitive element 180 is opposed to the charging device 62M, the photosensitive element 180 is negatively charged in a uniform manner by the charging device 62M. After an electrostatic latent image corresponding to the color of magenta is formed on the surface of the photosensitive element 180 with the laser light Lm, the photosensitive element 180 passes through a position where the photosensitive element 180 is opposed to the developing device 1M. Then, the electrostatic latent image formed on the surface of the photosensitive element 180 is developed by the developing device 1M whereby an M-toner image is formed on the surface of the photosensitive element 180.

After the M-toner image is formed on the surface of the photosensitive element 180, the photosensitive element 180 is moved from upward to downward in the longitudinal direction and is then uniformly charged by the charging device 62C. Then, an electrostatic latent image corresponding to the color of cyan is formed on the surface of the photosensitive element 180 with the laser light Lc. The electrostatic latent image is then developed by the developing device 1C whereby a C-toner image is formed on the surface of the photosensitive element 180. The C-toner image is developed such that the entire or a part of the C-toner image is superimposed on the M-toner image formed on the surface of the photosensitive element 180. The area where the C-toner image is superimposed on the M-toner image has a two-color image of magenta and cyan.

After the C-toner image is formed on the surface of the photosensitive element 180, the photosensitive element 180 is moved from upward to downward in the longitudinal direction and is then uniformly charged by the charging device 62Y. Then, an electrostatic latent image corresponding to the color of yellow is formed on the surface of the photosensitive element 180 with the laser light Ly. The electrostatic latent image is then developed by the developing device 1Y whereby a Y-toner image is formed on the surface of the photosensitive element 180. The Y-toner image is developed such that the entire or a part of the Y-toner image is superimposed on the M-toner image, the C-toner image, or the two-color image of magenta and cyan formed on the surface of the photosensitive element 180. The area where the Y-toner image is superimposed has a two-color image of magenta and yellow, a two-color image of cyan and yellow, or a three-color image of magenta, cyan, and yellow.

After the Y-toner image is formed on the surface of the photosensitive element 180, the photosensitive element 180 is moved from upward to downward in the longitudinal direction and is then uniformly charged by the charging device 62K. An electrostatic latent image corresponding to the color of black is formed on the surface of the photosensitive element 180 with the laser light Lk. The electrostatic latent image is developed by the developing device 1K whereby a K-toner image is formed on the surface of the photosensitive element 180.

Thus, the M-toner image, the C-toner image, the Y-toner image, and the K-toner image are developed in a superimposed manner, so that a four-color toner image is formed on the outer surface of the photosensitive element 180. Each of the charging devices 62C, 62M, 62Y, and 62K uniformly charges the photosensitive element 180 by corona discharge.

After the photosensitive element 180 passes through a developing area at a position where the photosensitive element 180 is opposed to the developing device 1K and then passes through a support area where the photosensitive element 180 is supported by the drive roller 83, the photosensitive element 180 is moved from downward to upward in the longitudinal direction. The photosensitive element 180 then reaches a support area where the photosensitive element 180 is supported by the transfer backup roller 85. The transfer roller 87 is in contact with the outer surface of the photosensitive element 180 at the support area whereby a transfer nip is formed between the transfer backup roller 85 and the transfer roller 87. While the transfer backup roller 85 is grounded, a transfer bias is applied to the conductive transfer roller 87 by a bias applying unit (not shown). Thus, an electric field for electrostatically transferring the toner image formed on the surface of the photosensitive element 180 toward the transfer roller 87 is formed between the transfer backup roller 85 and the transfer roller 87.

The feed cassette 78 rotates a feed roller 78*a* at predetermined timing, so that a recording medium P contained in the feed cassette 78 is fed toward a feed path. The fed recording medium P is then sandwiched between the registration rollers 79 arranged under the transfer nip as shown in FIG. 20. When the edge of the recording medium P is sandwiched between the registration rollers 79, the rotation of the registration rollers 79 is stopped immediately. The rotation of the registration rollers 79 is then started at timing such that the recording medium P is conveyed in synchronization with the four-color toner image formed on the surface of the photosensitive element 180 whereby the recording medium P is conveyed to the transfer nip.

When the four-color toner image formed on the surface of the photosensitive element 180 is in close contact with the recording medium P at the transfer nip, the four-color toner image is transferred onto the recording medium P from the photosensitive element 180 due to a nip pressure or an effect caused by the electric field, so that a full-color image is formed on the recording medium P in combination with the white color of the recording medium P. After the full-color image is formed on the recording medium P, the recording medium P is conveyed from the transfer nip to the fixing device 88 and then discharged out of the image forming apparatus.

Figure 22:
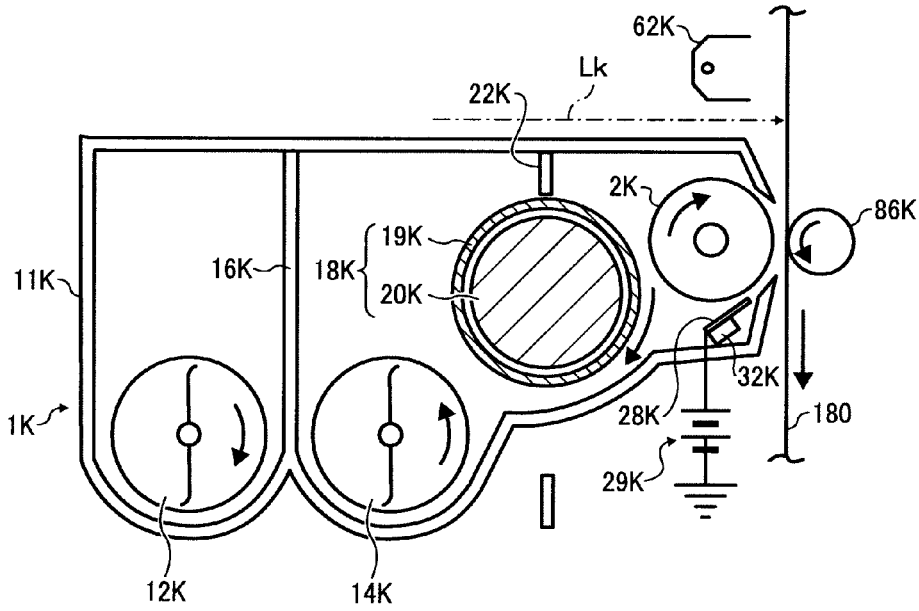
FIG. 22 is an enlarged view of the process cartridge corresponding to the color of black and a photosensitive element shown in FIG. 20.

FIG. 22 is an enlarged view of the process cartridge corresponding to the color of black and the photosensitive element 180. The same components as those shown in FIG. 2 are indicated with reference numerals accompanying the reference mark K in FIG. 22. In the developing device 1K, a post-development electrode 28K is opposed to the post-development conveying area A4 arranged on a surface of a toner carrying roller 2K. One side of the post-development electrode 28K is supported by an oscillator 32K, and a free end of the post-development electrode 28K is opposed to the toner carrying roller 2K.

The K-toner that has not transferred onto the surface of the photosensitive element 180 for development at the developing area A3 is conveyed to the post-development conveying area A4 arranged on the surface of the toner carrying roller 2K, and then transferred onto the surface of the post-development electrode 28K to which a post-development bias is applied. In this manner, the K-toner is removed from the surface of the toner carrying roller 2K at the post-development conveying area A4.

When the developing operation is stopped, for example, after the print job ends, the post-development bias applied to the post-development electrode 28K is stopped. Afterward, while the post-development electrode 28K is grounded by an operation of a relay switch (not shown) connected to the post-development electrode 28K, the oscillator 32K is operated so that the K-toner is shook off the surface of the post-development electrode 28K. The K-toner then falls down to a contact position where the K-toner is in contact with the magnetic brush formed on a toner supply sleeve 19K due to gravity, and is carried by the magnetic brush.

It is preferable that the post-development electrode 28K is arranged such that the surface of the post-development electrode 28K to which the K-toner adheres tilts as shown in FIG.

22, so that the K-toner easily slips off the surface of the post-development electrode 28K.

Alternatively, it is possible that the bias applied to the post-development electrode 28K is changed to a bias having the same polarity as that of the K-toner at predetermined timing, for example, after the print job ends, so that the K-toner is transferred from the post-development electrode 28K to the toner carrying roller 2K.

Although the configuration of the developing device 1K is described above in detail, the explanation about the configurations of the developing devices 1C, 1M, and 1Y is omitted because they have the same configuration as that of the developing device 1K. Moreover, the process cartridge can include a cleaning unit and a photosensitive element in an integrated manner instead of the charging device or in addition to the charging device.

An image forming apparatus according to a third modification of the present invention has the same configuration as that of the image forming apparatus according to the second modification except for the point described below.

Figure 23:
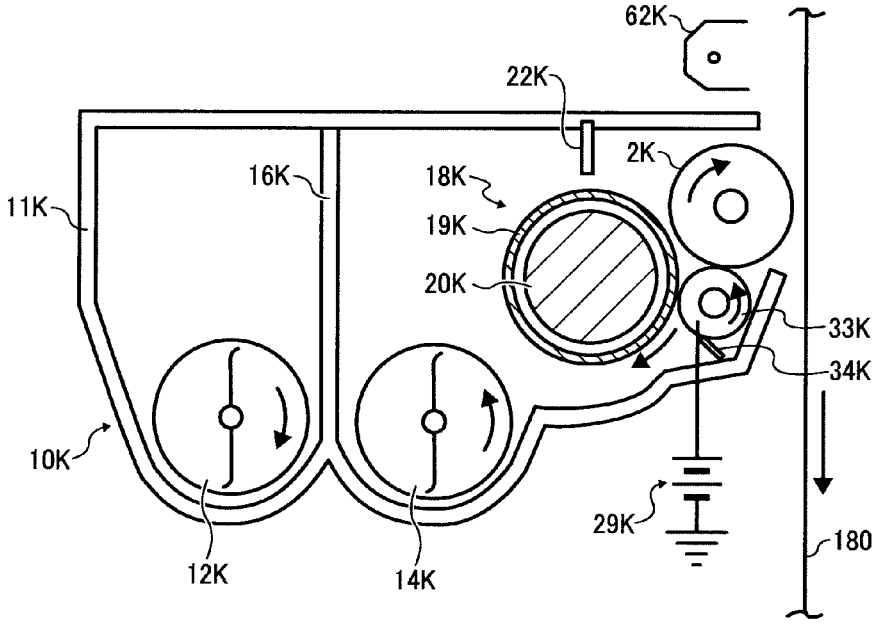
FIG. 23 is an enlarged view of a process cartridge corresponding to the color of black and the photosensitive element in an image forming apparatus according to a third modification of the present invention.

FIG. 23 is an enlarged view of a process cartridge corresponding to the color of black and the photosensitive element 180 in the image forming apparatus according to the third modification. A developing device 10K includes a post-development roller 33K serving as the post-development electrode. A post-development bias having a polarity opposite to that of the K-toner is applied to the post-development roller 33K from a post-development bias power source 29K while the post-development roller 33K is rotated in the counterclockwise direction shown in FIG. 23 by a drive unit (not shown).

The K-toner that has not transferred onto the surface of the photosensitive element 180 for development at the developing area A3 is transferred from the surface of the toner carrying roller 2K to the surface of the post-development roller 33K at the post-development conveying area A4. When the K-toner reaches a contact area where the post-development roller 33K is in contact with a cleaning blade 34K serving as a separating unit in accordance with the rotation of the post-development roller 33K, the K-toner is removed from the surface of the post-development roller 33K by the cleaning blade 34K. Afterward, the K-toner falls down to the contact position where the K-toner is in contact with the magnetic brush formed on the toner supply sleeve 19K due to gravity, and is carried by the magnetic brush.

It is preferable that the post-development roller 33K is rotated such that the surface of the post-development roller 33K and the surface of the toner carrying roller 2K are moved in the same direction at a position where the post-development roller 33K is opposed to the toner carrying roller 2K. Furthermore, it is preferable that a linear velocity (surface moving velocity) of the post-development roller 33K is faster than that of the toner carrying roller 2K. With this configuration, the surface of the post-development roller 33K on which the K-toner is not present is opposed to the k-toner on the toner carrying roller 2K, so that the k-toner can be transferred onto the surface of the post-development roller 33K in an improved manner.

Figure 24:
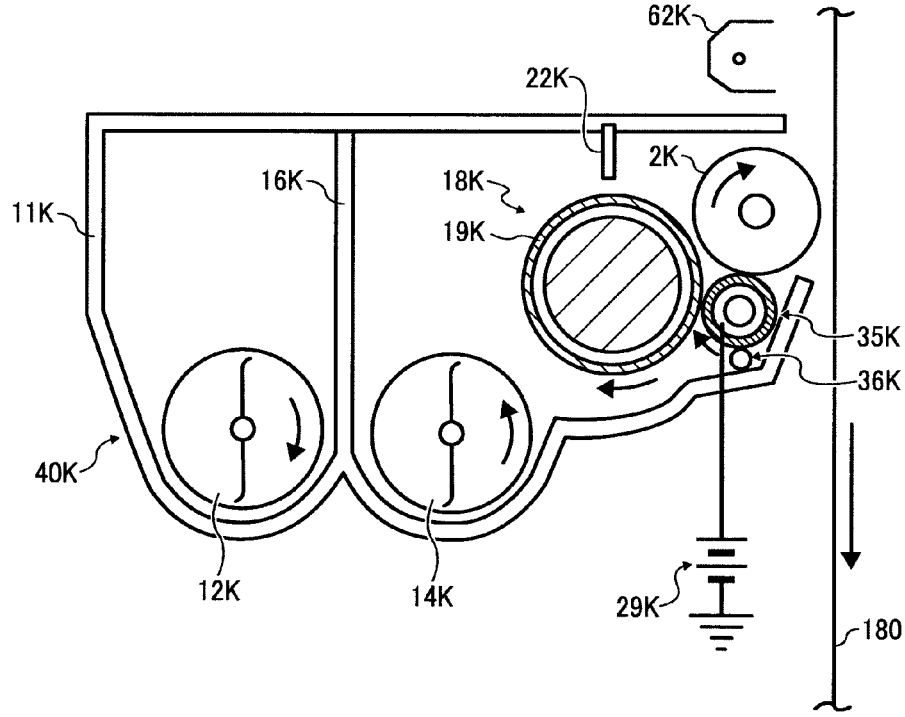
FIG. 24 is an enlarged view of a process cartridge corresponding to the color of black and the photosensitive element in an image forming apparatus according to a fourth modification of the present invention.

FIG. 24 is an enlarged view of a process cartridge corresponding to the color of black and the photosensitive element 180 in an image forming apparatus according to a fourth modification of the present invention. The image forming apparatus according to the fourth modification has the same configuration as that of the image forming apparatus according to the second modification except for the configuration of the developing devices.

A developing device 40K includes a removing brush roller 35K instead of the post-development electrode. The removing brush roller 35K includes a metallic rotary shaft member rotatably supported by a bearing and a brush portion including a plurality of conductive bristles arranged around the surface of the rotary shaft member in a standing manner.

A bias having a polarity opposite to that of the K-toner is applied to the rotary shaft member from the post-development bias power source 29K, and the removing brush roller 35K is rotated in a direction such that the brush portion is moved in a direction opposite to that in which the surface of the toner carrying roller 2K is moved at a contact area where the end of the brush portion is contact with the post-development conveying area A4 on the surface of the toner carrying roller 2K. Thus, the K-toner on the toner carrying roller 2K is removed by the brush portion at a position where the brush portion is in contact with the toner carrying roller 2K, while the k-toner is transferred onto the brush portion due to the effect of the bias.

The toner transferred onto the brush portion is shook off the brush portion due to impact caused when the bristles are snapped by a flicker bar 36K serving as a separating unit that extends in an axial direction of the removing brush roller 35K in contact with the brush portion. A bias roller can be in contact with the end of the brush portion instead of the flicker bar 36K. The K-toner shook off the brush portion by the flicker bar 36K falls down to a contact position where the k-toner is in contact with the magnetic brush formed on the toner supply sleeve 19K due to gravity, and is then carried by the magnetic brush.

Figure 25:
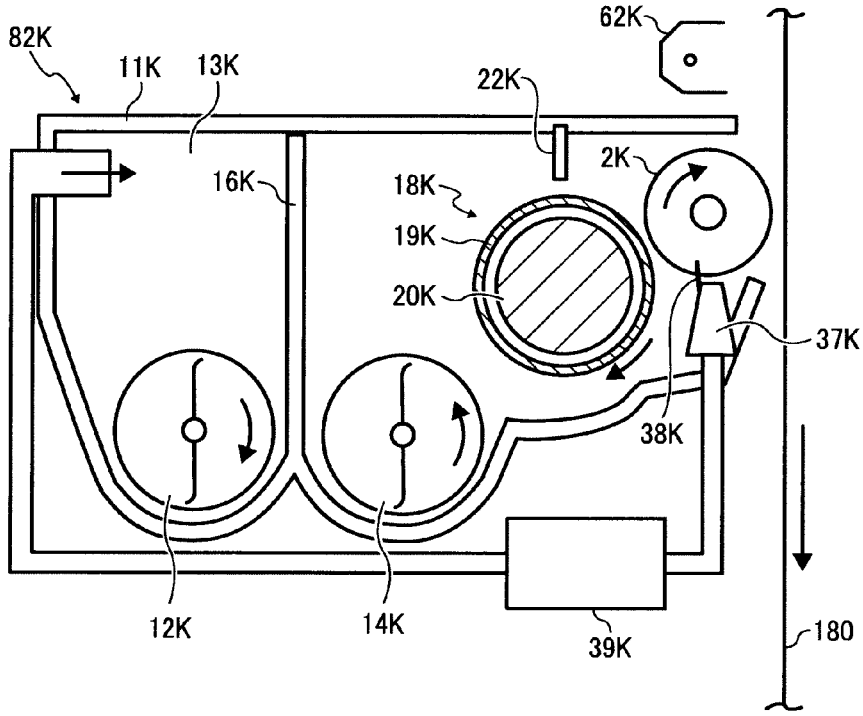
FIG. 25 is an enlarged view of a process cartridge corresponding to the color of black and the photosensitive element in an image forming apparatus according to a fifth modification of the present invention.

FIG. 25 is an enlarged view of a process cartridge corresponding to the color of black and the photosensitive element 180 in an image forming apparatus according to a fifth modification of the present invention. The image forming apparatus according to the fifth modification has the same configuration as that of the image forming apparatus according to the second modification except for the configuration of the developing devices.

A developing device 82K includes a suction nozzle 37K serving as a suction member instead of the post-development electrode.

The suction nozzle 37K is connected to a suction unit included in a suction pump 39K via a relay tube. A exhaust tube is connected to a discharge unit included in the suction pump 39K, and the end of the exhaust tube is connected to a first container 13K included in the developing device 82K.

When the suction pump 39K is operated, air is sucked through a suction opening arranged on the suction nozzle 37K. Then, the K-toner hopping on the post-development conveying area A4 near the suction opening is sucked through the suction opening together with air whereby the K-toner is removed from the surface of the toner carrying roller 2K. After the k-toner is sequentially conveyed to the relay tube, the suction pump 39K, and a discharge tube, the k-toner is returned to the first container 13K.

A seal member 38K is arranged downstream of the suction opening of the suction nozzle 37K in a direction to which the K-toner is conveyed such that one side of the seal member 38K is supported and a free end of the seal member 38K is in contact with the toner carrying roller 2K. Thus, it is possible to prevent the suction nozzle 37K from sucking the air around the toner supply sleeve 19K together with the K-toner contained in the magnetic brush. Furthermore, the K-toner moving by hopping in accordance with the rotation of the toner carrying roller 2K is stopped by the seal member 38K, so that the K-toner remains at a position where the K-toner is opposed to the suction opening.

It is preferable that a gap between the end of the suction nozzle 37K and the surface of the toner carrying roller 2K is set to several tens of μm to several hundreds of μm and the gap is smaller than the hopping height of the K-toner on the surface of the toner carrying roller 2K.

A pump such as a diaphragm pump or a Mohno pump that can suck powder like the K-toner is used as the suction pump 39K.

The present invention can be applied to a color image forming apparatus including an intermediate transfer belt, a transfer drum, and an intermediate transfer drum, or a monochrome image forming apparatus.

Figure 26:
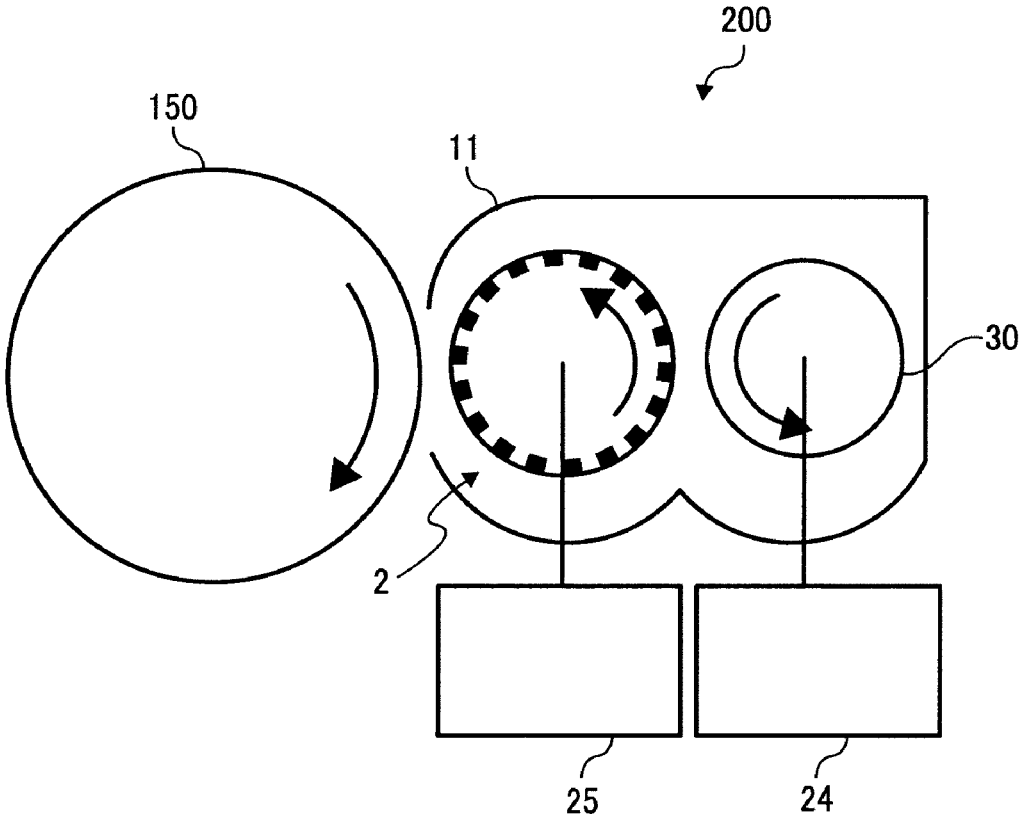
FIG. 26 is a schematic diagram for explaining the photosensitive element and a developing device in an image forming apparatus according to a sixth modification of the present invention.

FIG. 26 is a schematic diagram for explaining the photosensitive element 150 and a developing device 200 in an image forming apparatus according to a sixth modification of the present invention. The image forming apparatus according to the sixth modification forms a monochromatic image in the same manner as the image forming apparatuses according to the first and the second examples, and includes the photosensitive element 150 and the developing device 200.

The developing device 200 includes a toner container that contains toner. The toner container includes the toner supply roller 30. The toner supply roller 30 is rotated such that a roller portion made of an elastic material such as sponge included in the toner supply roller 30 is in contact with the toner carrying roller 2 and the surface of the roller portion is moved in a direction opposite to that in which the surface of the toner carrying roller 2 is moved at a contact area where the roller portion is in contact with the toner carrying roller 2. The toner on the toner supply roller 30 slides at the contact area where the toner carrying roller 2 is in contact with the toner supply roller 30 whereby the toner is electrically charged by friction and then transferred onto the toner carrying roller 2.

Although the surface of the toner supply roller 30 is moved in a direction opposite to that in which the surface of the toner carrying roller 2 is moved at the contact area where the roller portion is in contact with the toner carrying roller 2, the surface of the toner supply roller 30 and the surface of the toner carrying roller 2 can be moved in the same direction. The supply bias is applied to the toner supply roller 30 from the supply-bias power source 24. An amount of toner supplied from the toner supply roller 30 to the toner carrying roller 2 can be controlled by adjusting the supply bias. The supply bias can be a DC voltage or an AC voltage. It can be a voltage obtained by superimposing the AC voltage on the DC voltage.

It is explained above that the present invention is applied to the image forming apparatus in which the toner is moved back and forth between two adjacent electrodes by hopping whereby the flare phenomenon occurs while the toner is conveyed to the developing area in accordance with the surface movement of the toner carrying member. Alternatively, the present invention can be applied to an image forming apparatus in which the toner repeatedly hops from one electrode to an adjacent electrode on a toner carrying member in a direction from one end to the other end of the toner carrying member so that the toner is conveyed to the developing area, as described in Japanese Patent Application Laid-open No. 2007-133389. Moreover, it can be applied to an image forming apparatus in which the toner is conveyed to the developing area by both the above movement of the toner by hopping and the surface movement of the toner carrying member.

As described above, in the image forming apparatus according to the first example, the electric-field forming unit forms the electric fields having different characteristics at the first and the second areas of the roller portion 3 such that the Vpp of the voltage applied to one of the A-phase electrodes 3*a* and the B-phase electrodes 3*b* that causes the hopping of the toner carried at the first area is different from that of the voltage applied to the other one of the A-phase electrodes 3*a* and the B-phase electrodes 3*b* that causes the hopping of the toner carried at the second area. Thus, with a simple configuration that the Vpp of the alternating voltage for causing the hopping of the toner at the developing area is different from that of the alternating voltage for causing the hopping of the toner at the areas other than the developing area, it is possible that the electric field formed at the first area and the electric field formed at the second area have the different characteristics.

Furthermore, if a predetermined condition is satisfied, for example, if an amount of change in temperature or humidity exceeds a predetermined amount, the electric-field forming unit changes the Vpp of the alternating voltage for development applied to the electrode that causes the hopping of the toner carried at the first area. With this configuration, it is possible to obtain a stable hopping height of the toner at the developing area irrespective of the change in the hopping characteristics of the toner.

Moreover, if a predetermined condition is satisfied, the electric-field forming unit changes the Vpp of the alternating voltage for conveyance applied to the electrode that causes the hopping of the toner carried at the second area. With this configuration, it is possible to obtain a stable hopping height of the toner at the areas other than the developing area irrespective of the change in the hopping characteristics of the toner.

Furthermore, the electric-field forming unit causes the Vpp of the alternating voltage for development applied to the electrode that causes the hopping of the toner carried at the first area to be higher than that of the alternating voltage for conveyance applied to the electrode that causes the hopping of the toner carried at the second area. With this configuration, it is possible that the electric field is formed on the surface of the roller portion 3 such that the hopping height of the toner at the developing area is higher than that at the areas other than the developing area.

In the image forming apparatus according to the second example, the electric-field forming unit forms the electric fields having different characteristics at the first and the second areas of the roller portion 3 such that the frequency of the alternating voltage applied to one of the A-phase electrodes 3*a* and the B-phase electrodes 3*b* that causes the hopping of the toner carried at the first area is different from that of the alternating voltage applied to the other one of the A-phase electrodes 3*a* and the B-phase electrodes 3*b* that causes the hopping of the toner carried at the second area. Thus, with a simple configuration that the frequency of the alternating voltage for causing the hopping of the toner at the developing area is different from that of the alternating voltage for causing the hopping of the toner at the areas other than the developing area, it is possible that the electric field formed at the first area and the electric field formed at the second area have the different characteristics.

Furthermore, if a predetermined condition is satisfied, the electric-field forming unit changes the frequency of the alternating voltage for development applied to the electrode that causes the hopping of the toner carried at the first area. With this configuration, it is possible to obtain a stable hopping height of the toner at the developing area irrespective of the change in the hopping characteristics of the toner.

Moreover, if a predetermined condition is satisfied, the electric-field forming unit changes the frequency of the alternating voltage for conveyance applied to the electrode that causes the hopping of the toner carried at the second area. With this configuration, it is possible to obtain a stable hopping height of the toner at the areas other than developing area irrespective of the change in the hopping characteristics of the toner.

Furthermore, the electric-field forming unit causes the frequency of the alternating voltage for development applied to the electrode that causes the hopping of the toner carried at the first area to be lower than that of the alternating voltage for conveyance applied to the electrode that causes the hopping of the toner carried at the second area. With this configuration, it is possible that the electric field is formed on the surface of the roller portion 3 such that the hopping height of the toner at the developing area is higher than that at the areas other than the developing area.

According to one aspect of the present invention, it is possible to prevent the development failure of the isolated dot and the splattering of the toner from the surface of the toner carrying member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a toner carrying member that includes a plurality of electrodes arranged in a predetermined direction and carries toner on its surface; and an electric-field forming unit that forms an electric field on a surface of the toner carrying member by applying a voltage to at least a part of the electrodes, wherein the electric-field forming unit forms electric fields having different characteristics at a first area on the surface of the toner carrying member located within a developing area and a second area on the surface of the toner carrying member located out of the developing area such that a hopping height of the toner at the first area is higher than that at the second area.

2. The developing device according to claim 1, wherein the electric-field forming unit applies a first voltage to an electrode that causes hopping of the toner carried at the first area and a second voltage that is different from the first voltage to an electrode that causes the hopping of the toner carried at the second area.

3. The developing device according to claim 2, wherein upon a predetermined condition being satisfied, the electric-field forming unit changes the first voltage.

4. The developing device according to claim 3, wherein upon a predetermined condition being satisfied, the electric-field forming unit changes the second voltage.

5. The developing device according to claim 2, wherein the first voltage is higher than the second voltage.

6. The developing device according to claim 1, wherein the electric-field forming unit applies a first voltage having a first frequency to an electrode that causes hopping of the toner carried at the first area and a second voltage having a second frequency that is different from the first frequency to an electrode that causes the hopping of the toner carried at the second area.

7. The developing device according to claim 6, wherein upon a predetermined condition being satisfied, the electric-field forming unit changes the first frequency.

8. The developing device according to claim 7, wherein upon a predetermined condition being satisfied, the electric-field forming unit changes the second frequency.

9. The developing device according to claim 6, wherein the first frequency is lower than the second frequency.

10. A process cartridge for an image forming apparatus that includes a latent-image carrying member that carries a latent image, a charging unit that charges the latent-image carrying member, a developing unit that develops the latent image thereby forming a toner image on a surface of the latent-image carrying member, a transferring unit that transfers the toner image from the surface of the latent-image carrying member to a transfer member, and a cleaning unit that, after the transferring unit transfers the toner image to the transfer member, removes residual toner from the surface of the latent-image carrying member, wherein the process cartridge includes the developing unit and at least one of the latent-image carrying member, the charging unit supported by a common supporting member as a single unit, so that the process cartridge can be installed in a detachable in the image forming apparatus in an integrated manner, and the developing unit includes a toner carrying member that includes a plurality of electrodes arranged in a predetermined direction and carries toner on its surface, and an electric-field forming unit that forms an electric field on a surface of the toner carrying member by applying a voltage to at least a part of the electrodes, wherein the electric-field forming unit forms electric fields having different characteristics at a first area on the surface of the toner carrying member located within a developing area and a second area on the surface of the toner carrying member located out of the developing area such that a hopping height of the toner at the first area is higher than that at the second area.

11. An image forming apparatus comprising:

a latent-image carrying member that carries a latent image; and a developing unit that develops the latent image, wherein the developing unit includes a toner carrying member that includes a plurality of electrodes arranged in a predetermined direction and carries toner on its surface, and an electric-field forming unit that forms an electric field on a surface of the toner carrying member by applying a voltage to at least a part of the electrodes, wherein the electric-field forming unit forms electric fields having different characteristics at a first area on the surface of the toner carrying member located within a developing area and a second area on the surface of the toner carrying member located out of the developing area such that a hopping height of the toner at the first area is higher than that at the second area.

* * * * *